US012491556B2

(12) United States Patent
Beardsley et al.

(10) Patent No.: US 12,491,556 B2
(45) Date of Patent: Dec. 9, 2025

(54) MACHINE FOR FORMING KNOTTED FENCE MESH

(71) Applicant: SOUTH FENCE MACHINERY LIMITED, Christchurch (NZ)

(72) Inventors: Karl Beardsley, Prebbleton (NZ); Benjamin Laurie Byers, Rolleston (NZ); Jack Hendrikz, Prebbleton (NZ)

(73) Assignee: SOUTH FENCE MACHINERY LIMITED, Christchurch (NZ)

( * ) Notice: Subject to any disclaimer, the term of this patent is extended or adjusted under 35 U.S.C. 154(b) by 430 days.

(21) Appl. No.: 17/951,382

(22) Filed: Sep. 23, 2022

(65) Prior Publication Data

US 2023/0415221 A1 Dec. 28, 2023

(51) Int. Cl.
*B21F 27/00* (2006.01)

(52) U.S. Cl.
CPC ..... *B21F 27/00* (2013.01)

(58) Field of Classification Search
CPC ..... B21F 27/00; B21F 27/02; B21F 27/04; B21F 15/04; B21F 33/007
See application file for complete search history.

(56) References Cited

U.S. PATENT DOCUMENTS 1,873,461 A * 8/1932 Nigro ..... B21F 15/04 5/257
2,351,659 A * 6/1944 Bronstien ..... B21F 33/04 140/92.8
5,467,804 A * 11/1995 Kupferschmidt ..... B21F 15/04 140/93.6
6,715,512 B2 4/2004 Richardson
2021/0146425 A1* 5/2021 Ullrich ..... B21F 15/06

FOREIGN PATENT DOCUMENTS

AU 2020/281041 A1 6/2021

* cited by examiner

*Primary Examiner* — Teresa M Ekiert
(74) *Attorney, Agent, or Firm* — Nelson Mullins Riley & Scarborough LLP

(57) ABSTRACT

A machine for forming knotted fence mesh has a plurality of side by side knot boxes. Each knot box is for forming a knot at an intersection between a line-wire and a stay-wire. Each of the knot boxes has a first pair of formers configured to move towards the line-wire-stay-wire intersection from a front side forming a knot at the line-wire-stay-wire intersection at each operation of the knot box, and a second pair of formers configured to move towards the line-wire-stay-wire intersection from a rear side at each operation of the knot box. The machine has a cam drive system configured to move a plurality of the first pair of formers and the second pair of formers at each operation of the knot boxes. The cam drive system has a front cam assembly having a front pair of cams associated with the first pair of formers and a rear cam assembly having a rear pair of cams associated with the second pair of formers, wherein each of the cams has a respective profile. The profiles of each of the front pair of cams associated are configured such that during a sector of a rotation of the front pair of cams associated, one of the first pair of formers accelerates while the other of the first pair of formers simultaneously decelerates.

32 Claims, 22 Drawing Sheets

MACHINE FOR FORMING KNOTTED FENCE MESH

CROSS-REFERENCE TO RELATED APPLICATION(S)

This application claims priority to New Zealand Patent Application. No. 789677, entitled "A Machine for Forming Knotted Fence Mesh" filed Jun. 22, 2022, which is hereby incorporated by reference in its entirety.

FIELD OF THE INVENTION

This invention relates to a machine for forming knotted fence mesh.

BACKGROUND OF THE INVENTION

Forms of fence mesh are known in which the wires forming the fence are knotted together at each or many wire intersections. In general knotted fence mesh is stronger than wire fence in which the fence wires are not knotted together at their intersections and which it is typically used for domestic or light industrial applications. Knotted fence mesh is used for applications where additional strength is required, such as for containing larger or stronger animals such as horses or deer for example; or as security fence for industrial and transport applications.

Knotted fence mesh with a rectangular or square mesh shape for example is typically formed from a number of generally parallel line-wires, which will extend generally horizontally when the fence mesh is set in position between fence posts, and lengths of stay-wire which extend laterally across the line-wires at regular spacings (and generally vertically when the fence mesh is set in position). In machines for forming knotted fence mesh a number of continuous line-wires are fed to a bed or knotting table of the machine comprising a number of similar knot boxes, and stay-wire is fed into the machine bed across the line-wires. Such machines typically have a step-wise operation and form a series of knots along a length of stay-wire at each intersection of the stay-wire and the line-wires at each operational step or "beat" of the machine. Typically such machines may operate at a rate of around 50 to 60 beats per minute. At each step or beat the line-wires are advanced forward in parallel through the side by side knot boxes at the machine bed, stay-wire is fed into the bed of the machine across the line-wires at the knot boxes, at approximately 90 degrees to the line-wires in case of a machine for forming rectangular fence mesh, one knot-wire passes through each knot box, a length of the stay-wire is cut, and simultaneously at each knot box at an intersection between the line-wires and the stay-wire each knot-wire is cut and a knot securing the stay-wire to the line-wire is formed.

U.S. Pat. No. 6,715,512 describes a knotted fence mesh forming machine including a plurality of side-by-side knot boxes each for forming a knot at the intersection between a line-wire and stay-wire, each of the knot boxes including at least one former arranged to move towards the line-wire-stay-wire intersection at each operation of the knot box, the former being hydraulically driven and/or hydraulically damped. More than one former may be provided in each knot box. A transversely moveable rack bar may be driven by a hydraulic cylinder, the transverse movement resulting in orthogonal movement of a drive bar which moves respective former or supports. A final former in each knot box is preferably hydraulically damped.

Conventional cam-driven knotted fence mesh forming machines typically operate in a manner in which the movement of one tool stops before the movement of another tool in an opposite direction starts, resulting in speed limitations and vibrations. As a result, a conventional knotted fence mesh forming machine has an operating rate of approximately 80 beats per minute. In addition, conventional cam-driven knotted fence mesh forming machines typically need to be individually adjusted and calibrated due to the vibrations causing components to move out of alignment.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide a knotted fence mesh forming machine that addresses one or more of the problems of conventional knotted fence mesh forming machines and/or to at least provide the public with a useful alternative.

SUMMARY OF THE INVENTION

In accordance with an aspect of the invention, there is provided a machine for forming knotted fence mesh, the machine comprising:

- a plurality of side by side knot boxes each for forming a knot at an intersection between a line-wire and a stay-wire, each of the knot boxes comprising:
- a first pair of formers configured to move towards the line-wire-stay-wire intersection from a front side forming a knot at the line-wire-stay-wire intersection at each operation of the knot box;
- a second pair of formers configured to move towards the line-wire-stay-wire intersection from a rear side at each operation of the knot box;
- a cam drive system configured to move a plurality of the first pair of formers and the second pair of formers at each operation of the knot boxes, the cam drive system having:
- a front cam assembly having a front pair of cams associated with the first pair of formers and a rear cam assembly having a rear pair of cams associated with the second pair of formers, wherein each of the cams has a respective profile,
- wherein the profiles of each of the front pair of cams are configured such that during a sector of a rotation of the front pair of cams, one of the first pair of formers accelerates while the other of the first pair of formers simultaneously decelerates.

In an embodiment, the profile of each of the rear pair of cams is configured such that during a sector of a rotation of the rear pair of cams, one of second pair of formers accelerates while the other of the second pair of formers simultaneously decelerates.

In an embodiment, the cam drive system is configured to simultaneously move the first pair of formers of all of the knot boxes or the second pair of formers of all of the knot boxes at each operation of the knot boxes.

In an embodiment, the cam drive system is configured to move the first formers of all of the knot boxes simultaneously with one another and the second formers of all of the knot boxes simultaneously with one another at each operation of the knot boxes.

In an embodiment, the front cam assembly comprises a front cam shaft configured to rotate at a constant speed.

In an embodiment, the rear cam assembly comprises a rear cam shaft configured to rotate at a constant speed.

In an embodiment, the first pair of formers comprises a blade tool and the blade tool is associated with a blade cam of the front pair of cams.

In an embodiment, the blade tool includes a notch having concave curved surface configured to support the stay-wire.

In an embodiment, the first pair of formers comprises a knot anvil and the knot anvil is associated with a knot cam of the front pair of cams.

In an embodiment, the knot anvil includes a generally U-shaped forming surface.

In an embodiment, the second pair of formers comprises a staple anvil and the staple anvil is associated with a staple cam of the rear pair of cams.

In an embodiment, the staple anvil includes a cutting edge configured to shear the knot-wire.

In an embodiment, the staple anvil includes a generally U-shaped forming surface.

In an embodiment, the second pair of formers comprises a support tool and the support tool is associated with a support tool of the rear pair of cams.

In an embodiment, the support tool includes a shallow concave curved surface configured to form and support the bow of the bent knot-wire.

In an embodiment, the machine further comprises a drive bar associated with each cam.

In an embodiment, the machine further comprises a cam follower between each cam and the associated drive bar.

In an embodiment, the machine further comprises a return cam follower associated with each tool and cam.

In an embodiment, during a first sector of a rotation of the cams, the blade tool is configured to move rearwardly towards the intersection and accelerate.

In an embodiment, the sector of rotation of the front pair of cams is a second sector of a rotation of the cams after the first sector, and the one of first pair of formers is a blade tool configured to move rearwardly towards the intersection and decelerate and the other of the first pair of formers is a knot anvil configured to move forwardly away from the intersection and accelerate.

In an embodiment, during a third sector after the second sector, the knot anvil is configured to move forwardly away from the intersection and accelerate and the staple anvil and the support tool are configured to move forwardly towards the intersection and accelerate.

In an embodiment, during a fourth sector after the third sector, the knot anvil is configured to move forwardly away from the intersection and decelerate while the staple anvil, the support tool is configured to move forwardly towards the intersection and accelerate.

In an embodiment, during a fifth sector after the fourth sector, the staple anvil and the support tool are configured to move forwardly towards the intersection and decelerate.

In an embodiment, during a sixth sector after the fifth sector, the knot anvil and the staple anvil are configured to move rearwardly and accelerate, and the staple anvil is configured to move away from the intersection and the knot anvil is configured to move with the staple anvil past the intersection.

In an embodiment, during a seventh sector after the sixth sector, the knot anvil and the staple anvil are configured to move rearwardly away from the intersection and decelerate.

In an embodiment, during an eighth sector after the seventh sector, the knot anvil is configured to move forwardly from behind the intersection and accelerate, the staple anvil is configured to move forwardly towards the intersection and accelerate, and the support tool is configured to move rearwardly away from the intersection and accelerate.

In an embodiment, during a ninth sector after the eighth sector, the knot anvil is configured to move forwardly away from the intersection and accelerate, the staple anvil is configured to move forwardly toward the intersection and accelerate, and the support tool is configured to move rearwardly away from the intersection and accelerate.

In an embodiment, during a tenth sector after the ninth sector, the knot anvil is configured to move forwardly away from the intersection and accelerate, the blade tool is configured to move forwardly away from the intersection and accelerate, the staple anvil is configured to move forwardly toward the intersection and accelerate, and the support tool is configured to move rearwardly away from the intersection and accelerate.

In an embodiment, during an eleventh sector after the tenth sector, the eleventh sector being the sector of a rotation of the rear pair of cams, the one of the second pair of formers is a knot anvil configured to move forwardly away from the intersection and decelerate, and the other of the second pair of formers is a blade tool configured to move forwardly away from the intersection and accelerate, the staple anvil is configured to move forwardly toward the intersection and accelerate, and the support tool is configured to move rearwardly away from the intersection and decelerate.

In an embodiment, during a twelfth sector after the eleventh sector, the blade tool is configured to move forwardly away from the intersection and decelerate, the staple anvil is configured to move forwardly toward the intersection and decelerate, and the support tool is configured to move rearwardly away from the intersection and decelerate.

In an embodiment, during a thirteenth sector after the twelfth sector, the knot anvil is configured to move rearwardly toward the intersection and accelerate and the staple anvil is configured to move forwardly toward the intersection and decelerate.

In an embodiment, during a fourteenth sector after the thirteenth sector, the knot anvil is configured to move rearwardly toward the intersection and decelerate and the staple anvil is configured to move forwardly toward the intersection and decelerate.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(s)' following a noun means the plural and/or singular form of that noun.

As used herein the term 'and/or' means 'and' or 'or', or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF A PREFERRED EMBODIMENT

Figure 1:
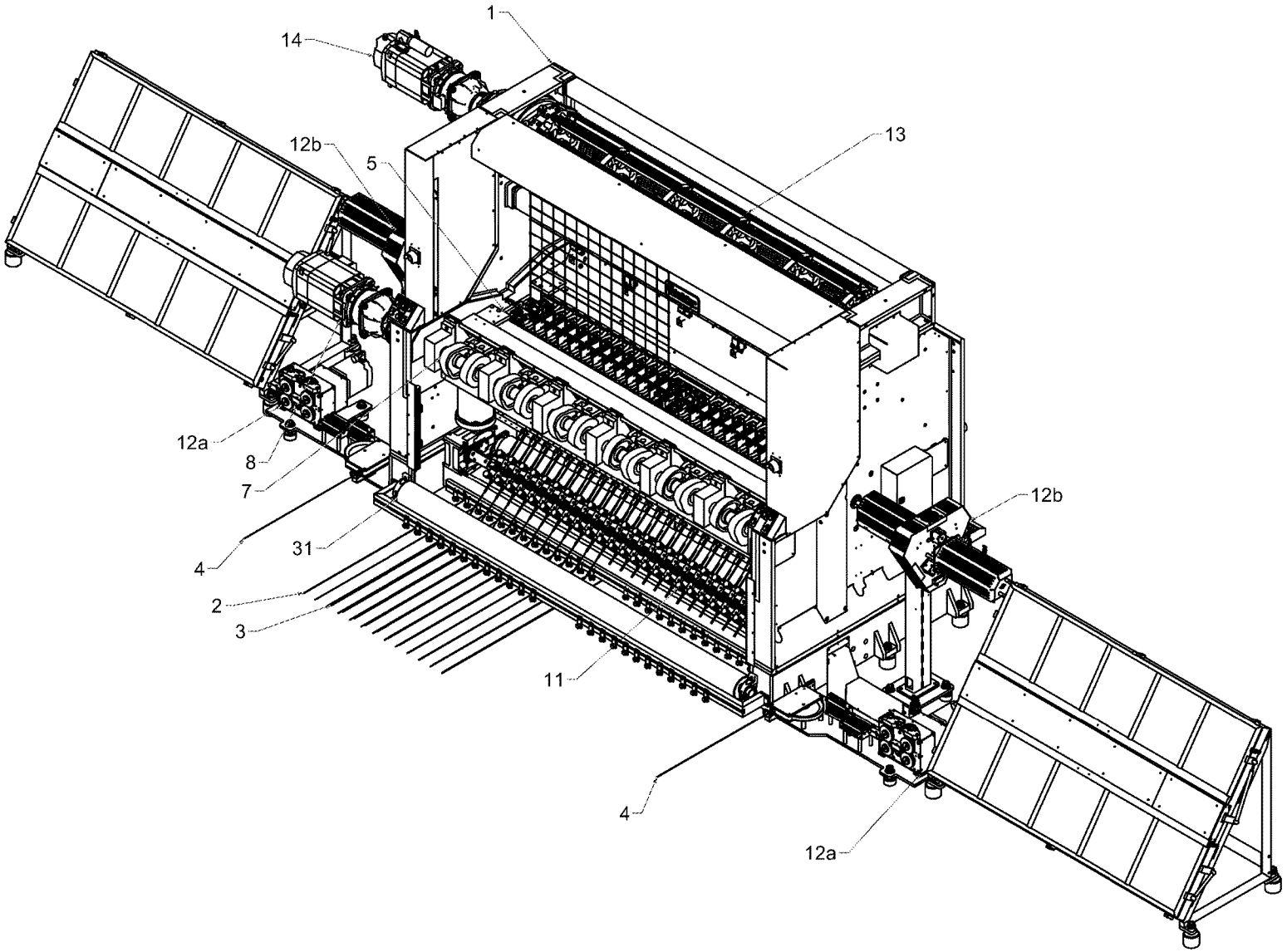
FIG. 1 is a perspective view from the front showing a fence mesh forming machine.

With reference to FIG. 1, a fence mesh forming machine is indicated generally by reference numeral 1.

FIG. 1*a* shows a number of continuous line-wires 2 and knot-wires 3 being fed to a knotting table 5 of the machine 1. The knotting table 5 has a plurality of side by side knot boxes 6. One line-wire 2 and one knot-wire 3 pass through each knot box 6 with different orientations. The line-wires 2 enter the machine at its base, are turned through 90 degrees around a roller (not shown) and then pass vertically through the knot boxes 6. The knot-wires 3 enter the machine at its base, are turned through 45 degrees around a roller 31 and then fed to four wheel drive knot-wire feed units 11. Next, each knot-wire feed units drives the knot-wire 3 through a feed tube to pass the wire at a 45 degree angle relative to both the vertical and horizontal through the knot boxes 6.

A continuous stay-wire 4 is projected across the knotting table 5 of the machine via a stay-wire pre-feed assembly 12*a* and a stay-wire Tri-drive assembly 12*b*, thereby forming a plurality of stay-wire-line-wire intersections.

It will be appreciated that the line-wires 2 are those which will extend generally horizontally when a fence mesh is set in position between fence posts, and the stay-wires 7 are those which extend laterally across the line-wires at regular spacings.

The machine 1 has a crimp drum 13 that pulls the completed fence mesh from the knot boxes 6, the drive roller being driven by crimp drum drive motor 14. The completed fence then would typically extend over a further rollers 15 (FIG. 2), and to a wind-up assembly or take-up unit (not shown) to form it into a roll for ease of handling and transportation.

The machine 1 generally has a step-wise operation and forms a series of knots along the length of stay-wire 4 at each line-wire-stay-wire intersection at each step or "beat" of the machine. At each step or beat, the line-wires 2 are advanced forward in parallel through the side by side knot boxes 6 in the machine knotting table 5 via the crimp drum 13, the stay-wire 4 is fed into the knotting table 5 of the machine across the line-wires at the knot boxes 6, at 90° for forming square fence mesh as shown, a length of the stay-wire 4 is cut, and simultaneously in each knot box 6 at each intersection between the line-wires and the stay-wire a knot securing the stay-wire to the line-wire is formed.

It will be understood that the relative orientations of the wires may be varied depending on the type of fence mesh required, and the details of the knot boxes 6 will vary depending on the type of knots and fence mesh required. Operation of one preferred type of knot box will be described with reference to FIGS. 14 to 20.

Figure 2:
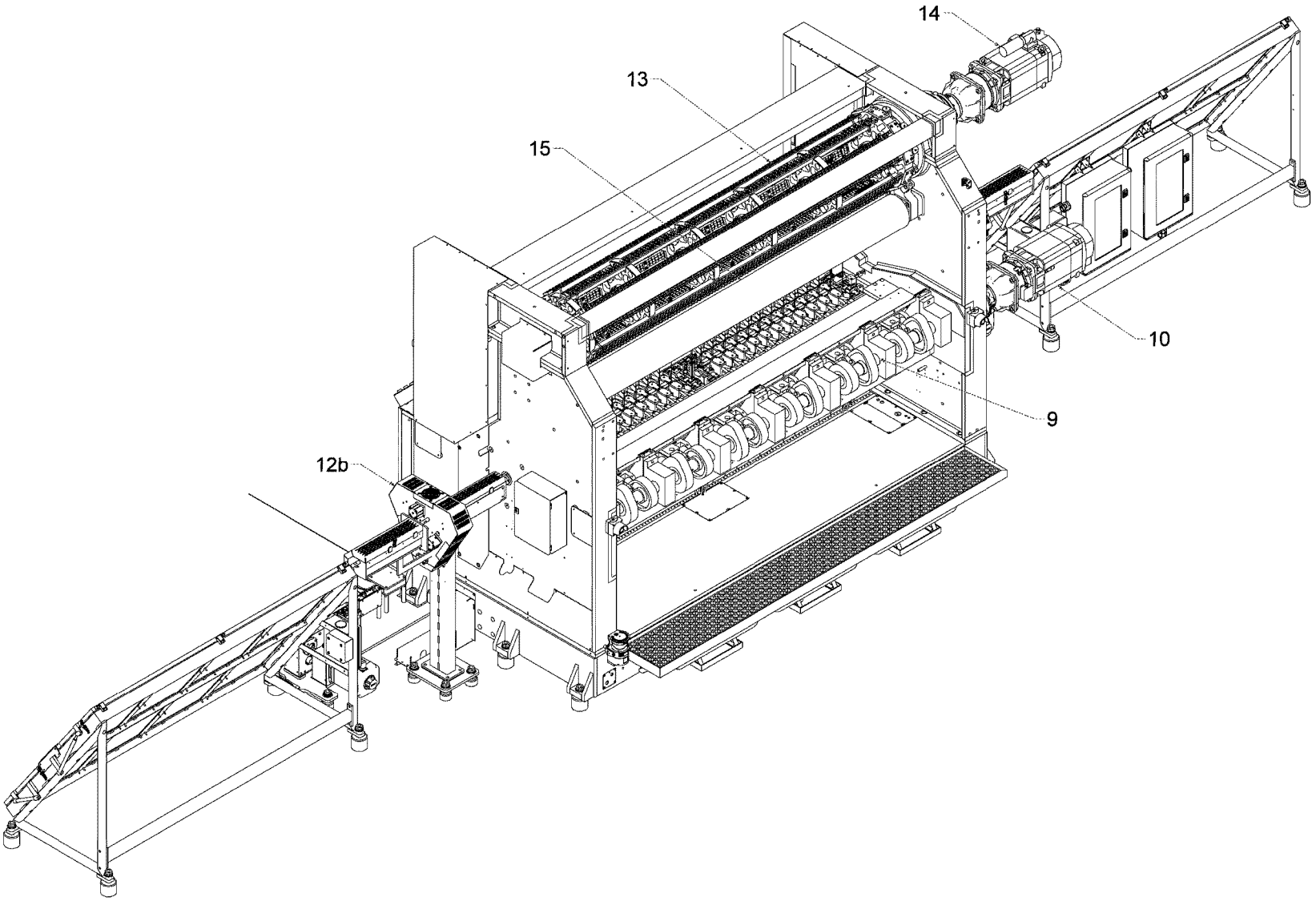
FIG. 2 is a perspective view from the rear showing the machine of FIG. 1.
Figure 4:
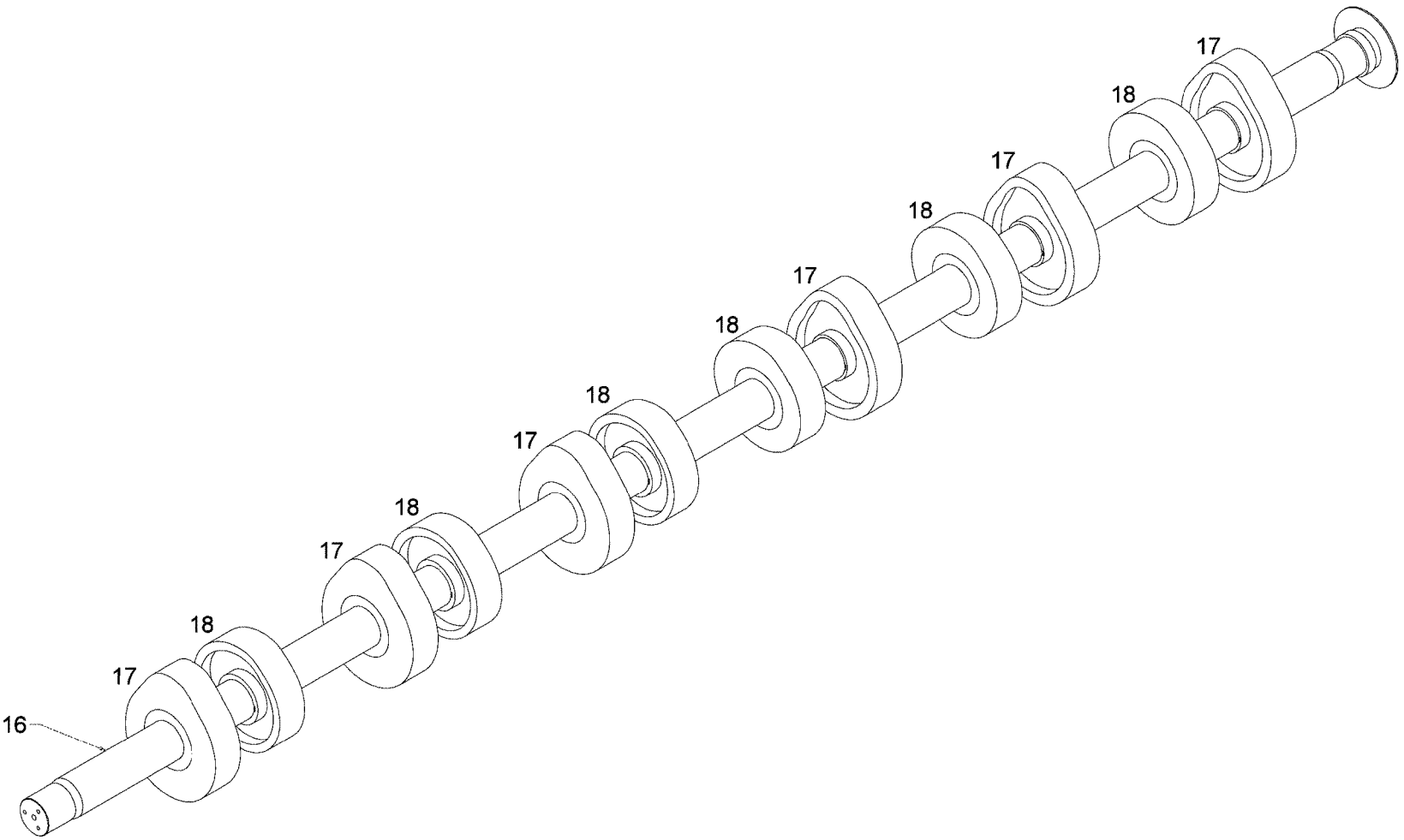
FIG. 4 shows the rear cam shaft with sets of cams.
Figure 5:
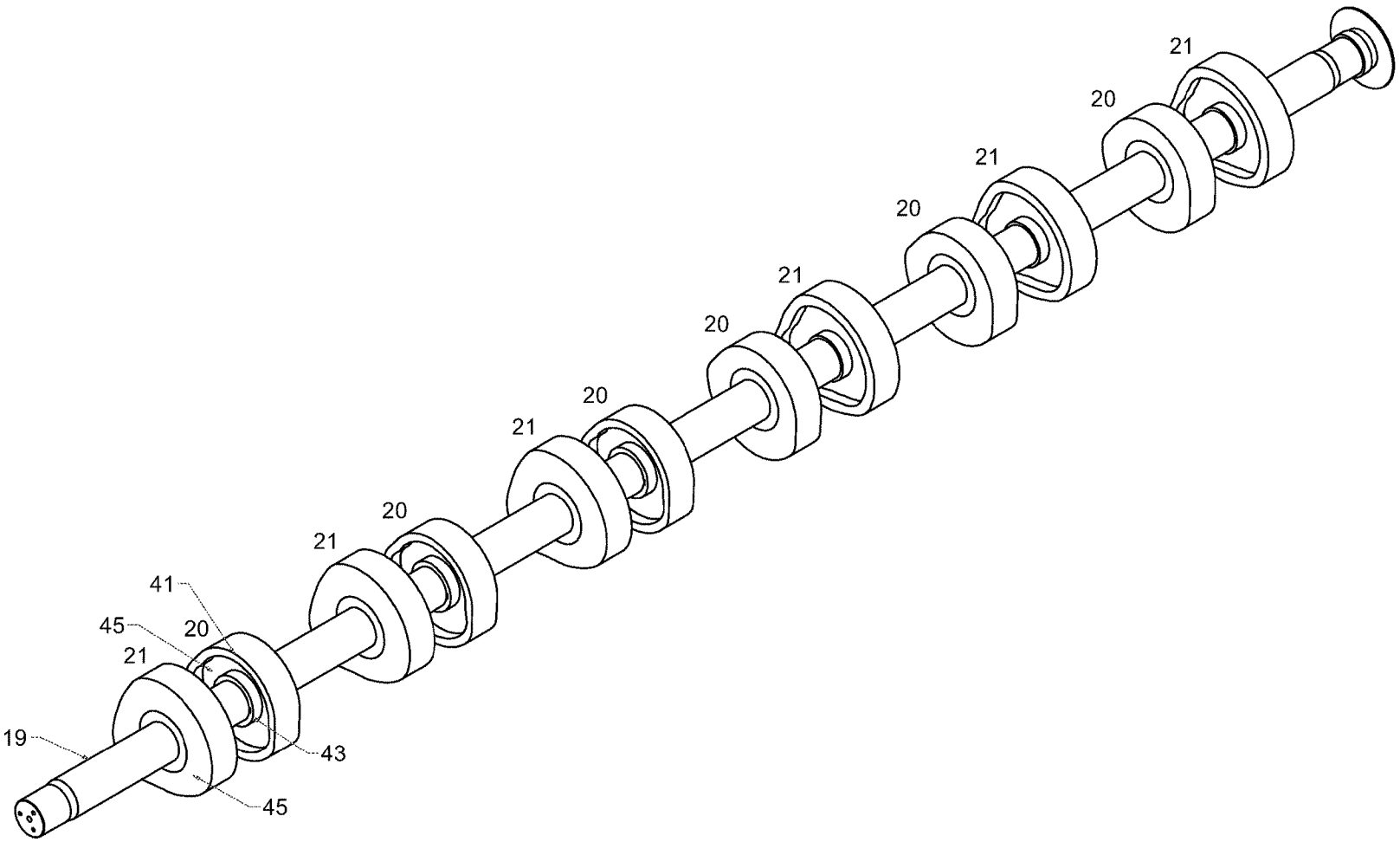
FIG. 5 shows the front cam shaft with sets of cams.

The various components of the machine will now be described. FIG. 4 shows a, rear shaft 16 with a plurality of cams 17, 18. The cams 17, 18 are provided in pairs, such as six pairs of cams 17, 18 as shown in the drawings. FIG. 5 shows a front shaft 19 with a plurality of cams 20, 21. Similar to the rear shaft 16, the cams 20, 21 are provided in six pairs. The rear shaft carries the support cam 18 and the staple cam 17. The front shaft carries the blade cam 20 and the knot cam 21. FIG. 1 shows a front cam shaft drive motor 8 and FIG. 2 shows a rear cam shaft drive motor 10, which drive the front shaft 19 and rear shaft 16 respectively. In an alternative embodiment, there may be two rear shafts—one shaft may have the staple cams 17 and one shaft may have the support cams 18. There may also be two front shafts.

One shaft may have the blade cam 20 and one shaft may have the knot cam 21.

The cams shown in the accompanying drawings have an exterior wall 41, an interior wall 43 and a side wall 45, which is most clearly shown in FIGS. 4 and 5. The cams are hollow between those walls, which reduces the mass of the cams compared to a solid cam. The reduced mass requires less energy to rotate than a solid cam. Further, the exterior wall provides both an exterior cam profile and an inner cam profile.

As mentioned above, the cams are provided in pairs. When assembled, the hollow interiors of the cams face each other. The distance between each pair of cams is less than the distance between one pair of cams and the adjacent pair of cams. Each cam 47 has a slot for receiving a corresponding key section of the shaft so that the cams rotate with the shaft.

Figure 7:
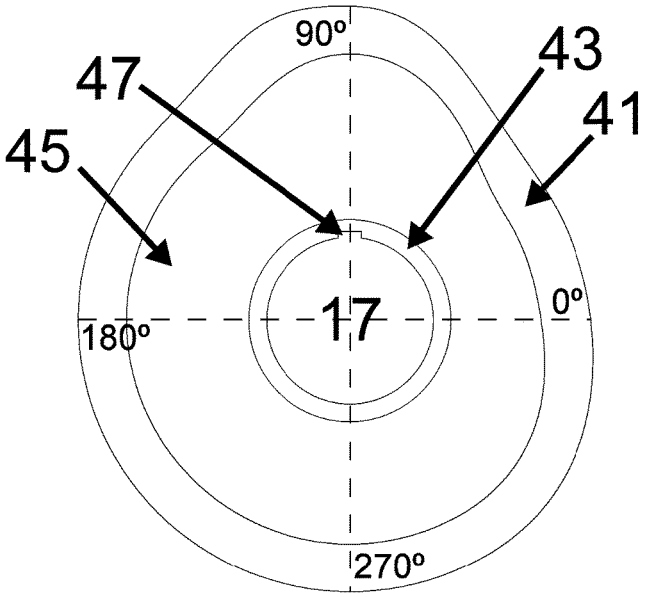
FIG. 7 shows the staple cam.

FIG. 7 shows the staple cam. A major part of the staple cam's outer profile is a constant radius and has the same profile as the base circle. From about 270° the radius decreases slightly until about 40° and then increases. This cam profile in the section is substantially linear. Next, the cam profile is a constant radius, which is larger than the base circle radius. Then the radius decreases back to the base circle radius. The decease of the radius is substantially linear. The inner cam profile closely follows the outer cam profile.

Figure 8:
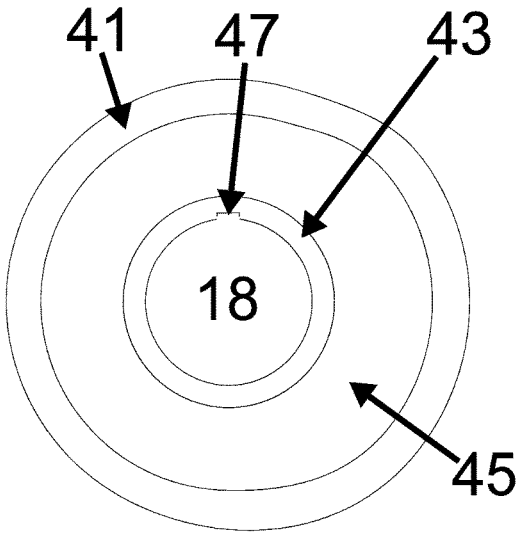
FIG. 8 shows the support cam.

FIG. 8 shows the support cam. A major part of the support cam's outer profile is a constant radius and has the same profile as the base circle. From about 280° the radius increases slightly until about 45°, where the radius decreases back to the base circle radius at about 80°. The increase of the radius is a constant increase. The decease of the radius is more abrupt—FIG. 8 shows this section of the profile is substantially linear. The inner cam profile closely follows the outer cam profile.

Figure 9:
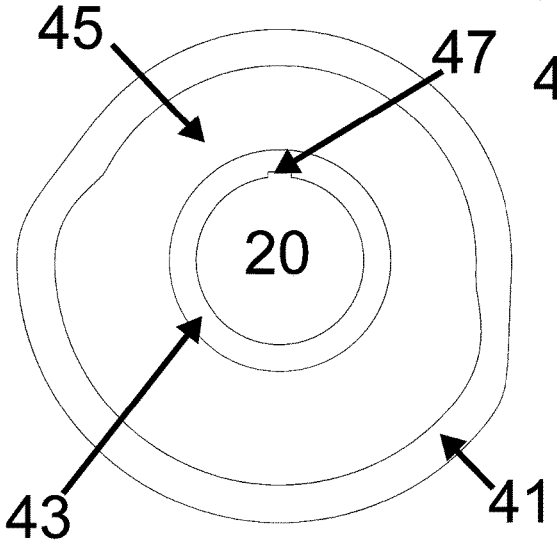
FIG. 9 shows the blade cam.

FIG. 9 shows the blade cam. About half of the blade cam's outer profile is a constant radius and has the same profile as the base circle. The other half of the cam is a lobe having a constant radius, which is larger than the base circle. The profile between the base circle and the lobe is substantially linear. The inner cam profile closely follows the outer cam profile, except for between 170° and 240° and between 270° and 40° where the profile has a slightly curved convex profile.

Figure 10:
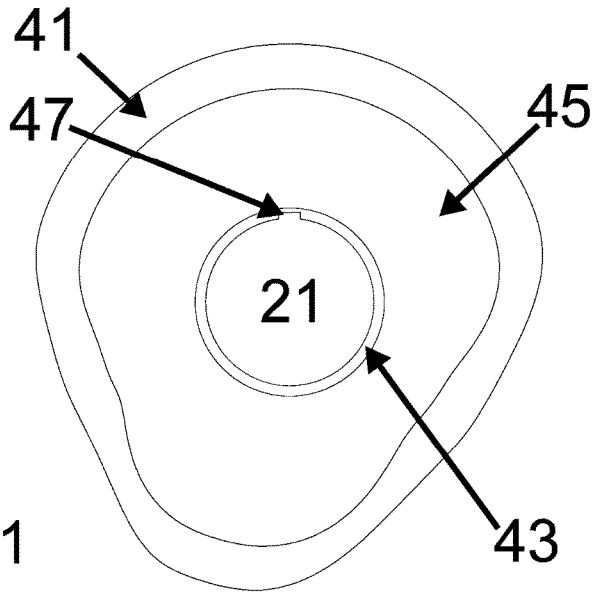
FIG. 10 shows the knot cam.
Figure 11:
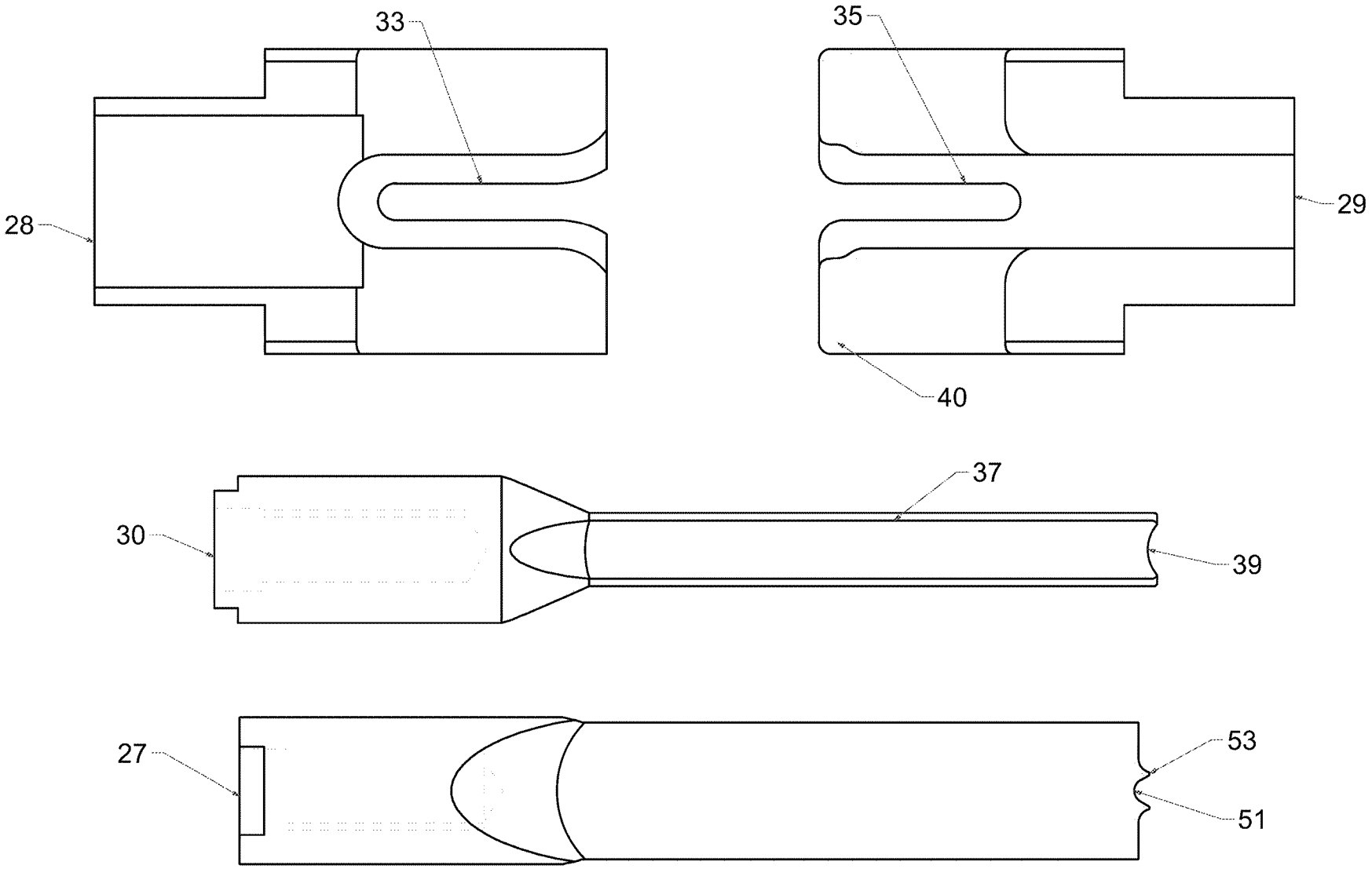
FIG. 11 shows each of the blade tool, the knot anvil, the staple anvil, and support tool.

FIG. 10 shows the knot cam. About half of the knot cam's outer profile, is a constant radius and has the same profile as the base circle. About a quarter of the cam decreases to the base circle radius then increases to form a lobe point. The final quarter of the cam decreases from the lobe point to a radius larger than the base circle radius then returns to the constant radius. The sections joining the base circle and the lobe are substantially linear profiles. The inner cam profile closely follows the outer cam profile.

Figure 6:
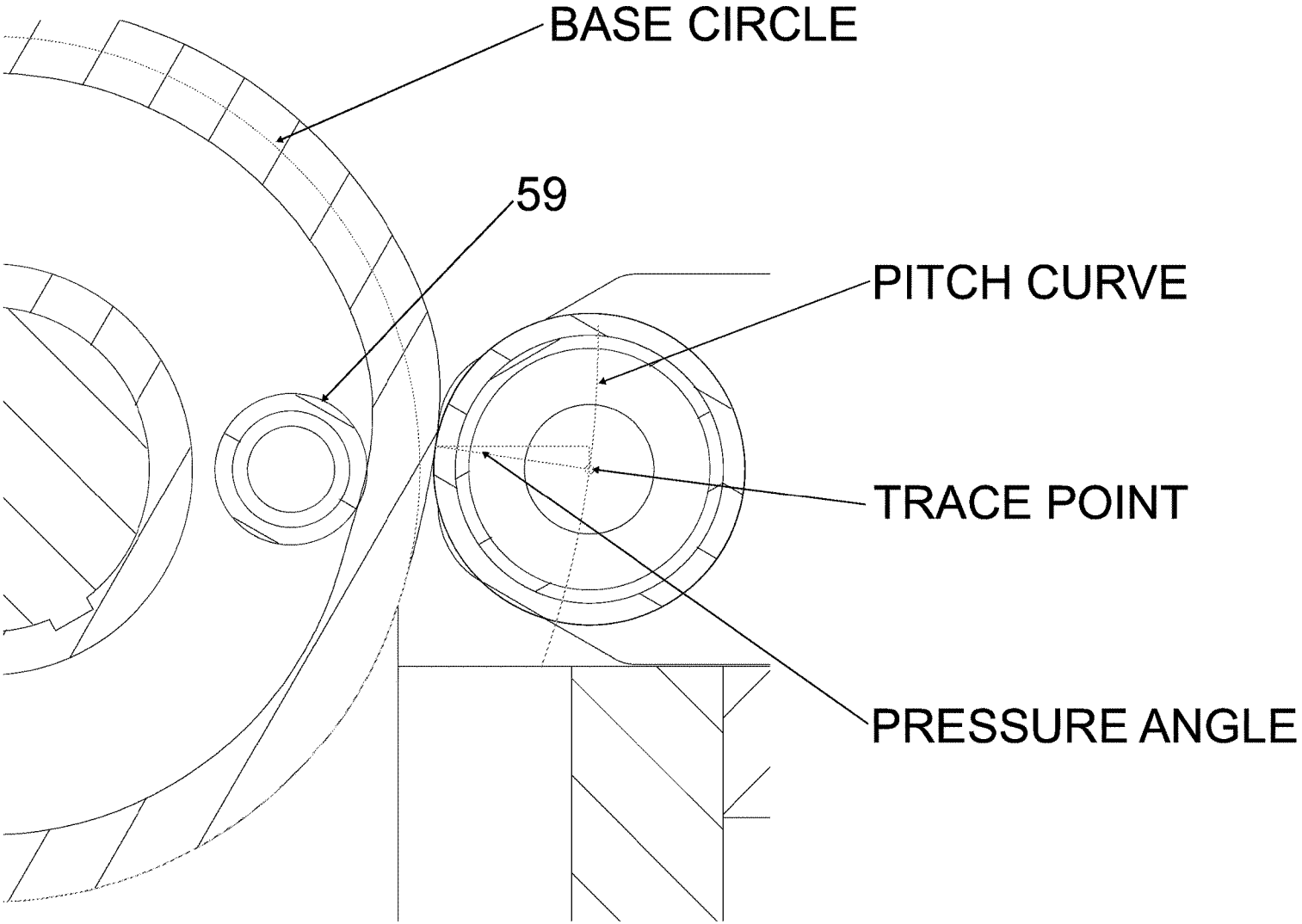
FIG. 6 is a diagram showing the features of a cam.

Each cam has been designed to minimise the pressure angles, velocities, and acceleration of the cam surface as the cam rotates. With reference to FIG. 6, the basic features of a cam are:

- Base circle—the smallest circle drawn a tangent to the cam profile from the centre.
- Tracepoint—a reference point on the follower to trace the cam profile, which is the centre of the roller follower in FIG. 6
- Pitch curve—the curve drawn by the Tracepoint.
- Pressure angle—the angle between the normal to the pitch curve at an instantaneous point and the direction of the follower motion. The pressure angle representing the steepness of the cam profile.

FIG. 6 shows the cam rotating in a clockwise direction. As shown in FIG. 6, the pressure angle has vertical and horizontal components. The force from the cam is applied to the follower at the pressure angle. The horizontal component of the force transfers to the former via the cam follower and drive bar. That is, the horizontal component of the force is used to form the knot. The vertical component of the force is lost from the machine and is typically transferred into wear pads (described below) as friction losses. By increasing the size of the cam compared to conventional cam designs, the profile of the cam is less steep, which increases the horizontal component of the pressure angle and decreases the vertical component of the pressure angle. As a result, more of the force provided by the cam is used to form the knot and less of the force is lost as friction.

Figure 3:
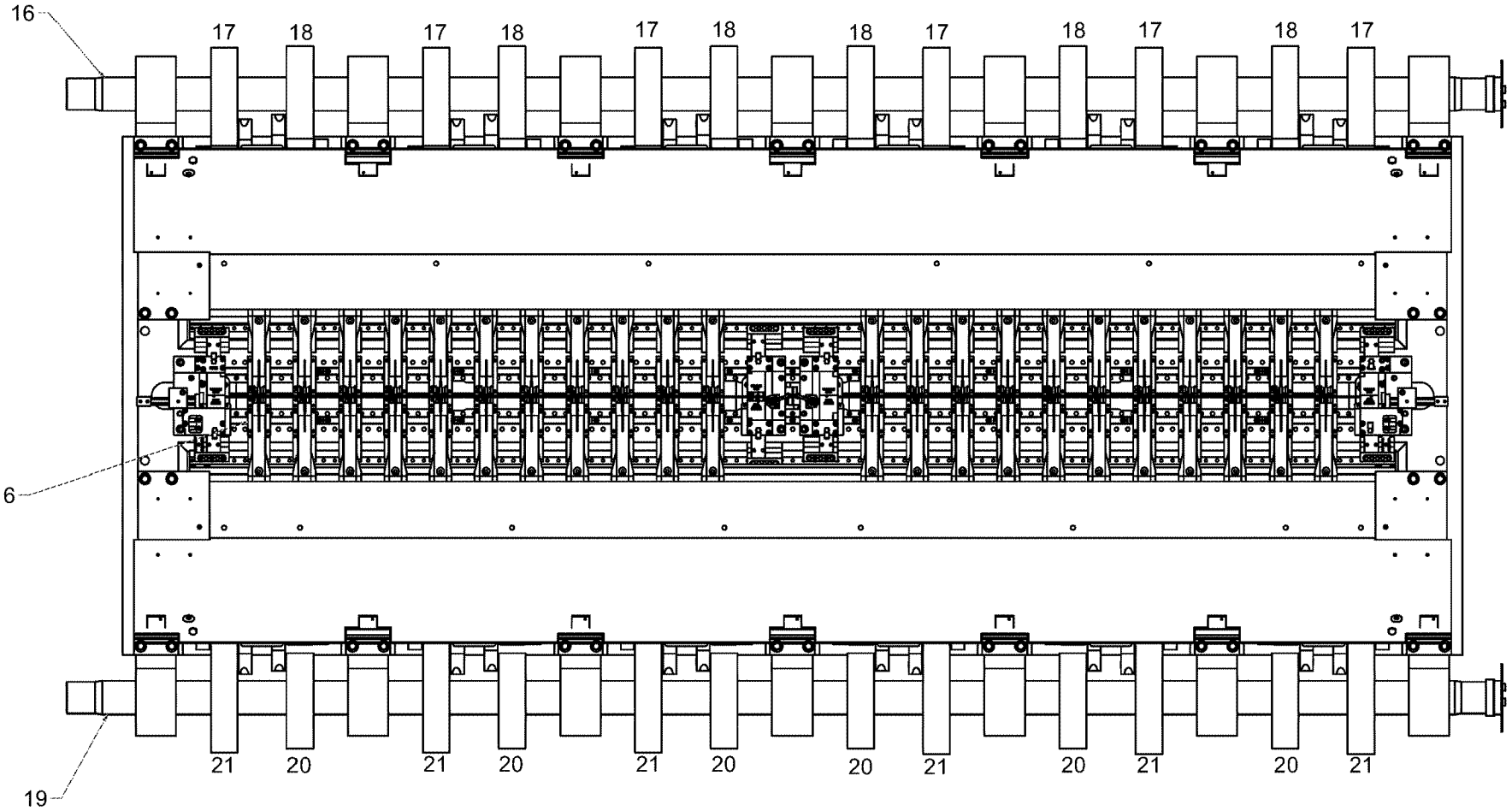
FIG. 3 shows the knotting table of the machine of FIG. 1.
Figure 13:
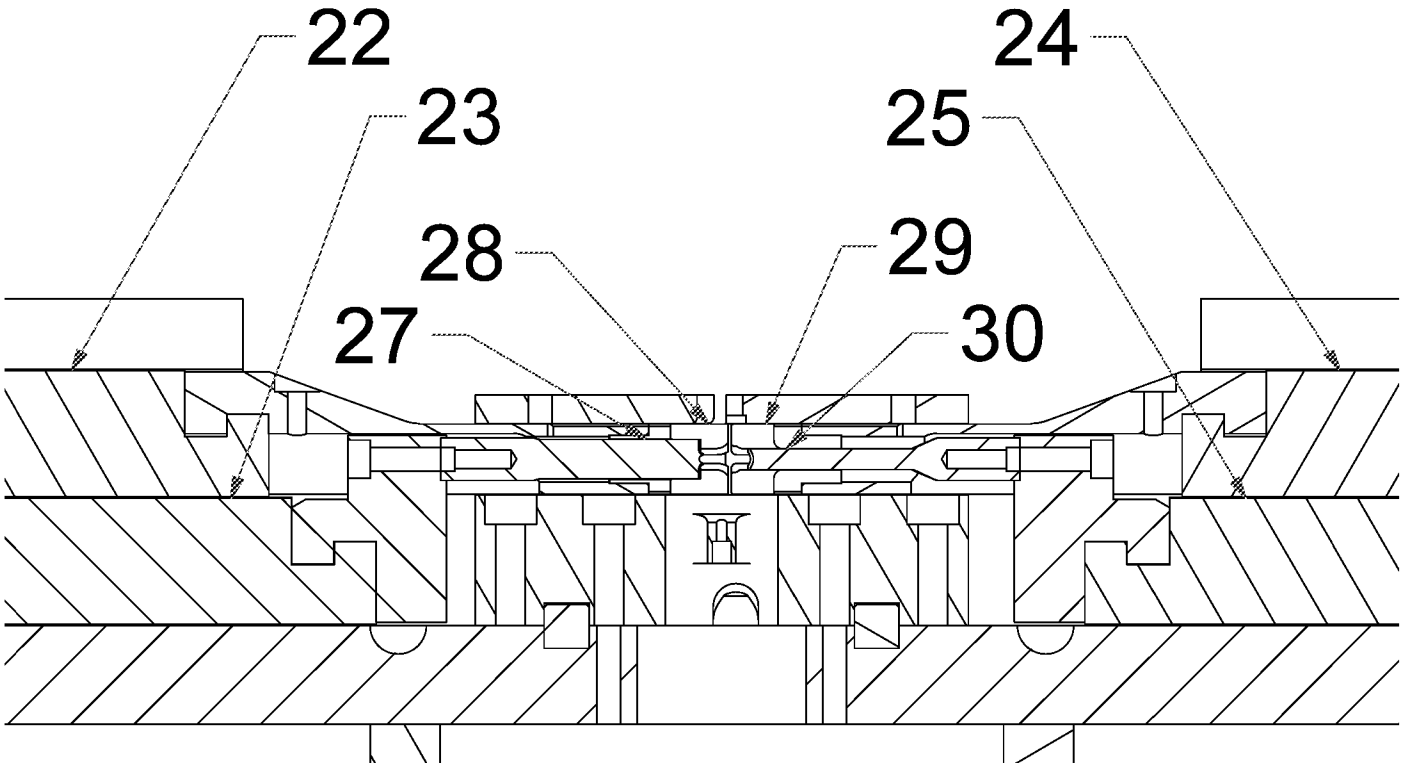
FIG. 13 is a detailed view of the knot box tooling.

The knotting table 5 with a plurality of preferred knot boxes 6 and the associated drive mechanisms is shown in FIG. 3. The plurality of knot boxes 6 are located in side by side configuration. FIG. 13 is a cross-section showing a knot box. Each knot box 6 has a first pair of formers configured to move towards the line-wire-stay-wire intersection from a front side forming a knot at the line-wire-stay-wire intersection at each operation of the knot box and a second pair of formers configured to move towards the line-wire-stay-wire intersection from a rear side at each operation of the knot box. The details and operation of those components will be described below.

Figure 12:
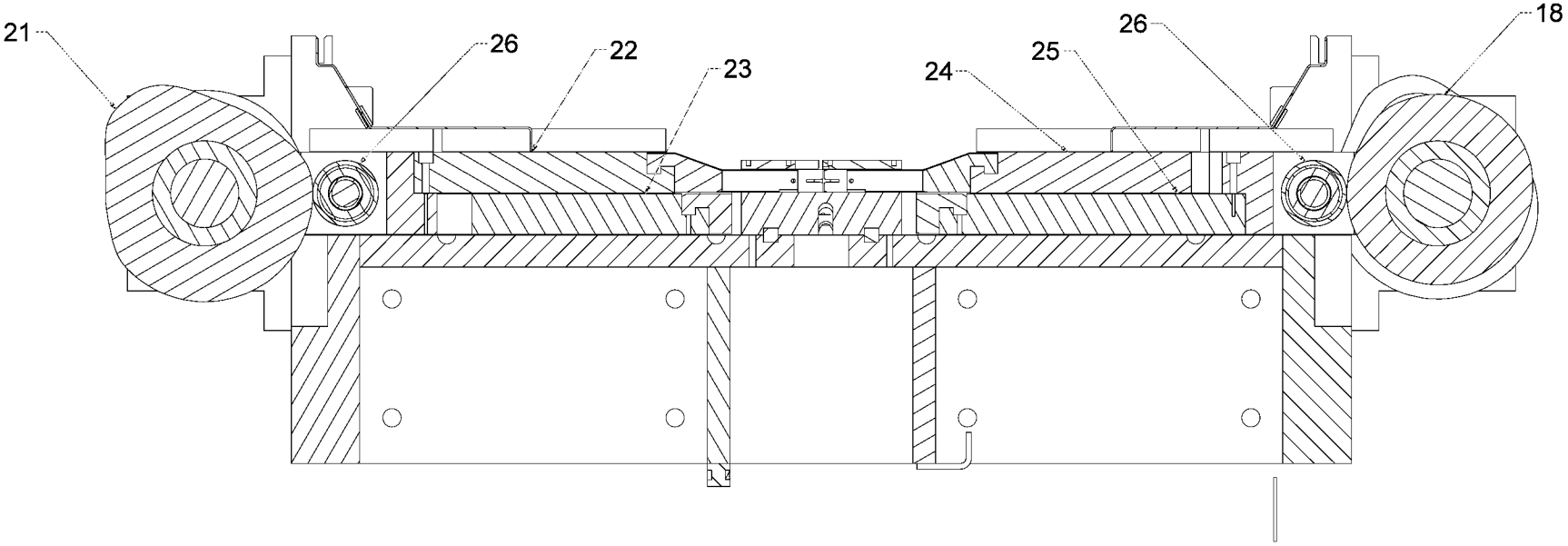
FIG. 12 is a cross-section showing drive bars and knot box tooling.

FIG. 12 shows the blade tool and knot anvil 28 at the front with the knot anvil drive bar above the blade tool drive bar, and the staple anvil and support tool at the rear with the support tool above the staple anvil.

Each cam 17, 18, 19, 20 is associated with a cam follower. Each cam follower is a roller 26 that is fixed to a drive bar. As shown in FIG. 12, each of the drive bars 22, 23, 24, 25 extend between the roller 26 at one end and a former at the other end. The formers 27, 28, 29, 30 are located near the intersection between the line-wires and the stay-wire. A blade tool 27 is fixed to the blade tool driver bar 23, a knot anvil 28 is fixed to the knot anvil driver bar 22, a staple anvil 29 is fixed to the staple anvil drive bar 25, and a support tool 30 is fixed to the support tool drive bar 24. Each of the drive bars has one or more wear pads between the bar and the table on which the bars slide. The drive bars slide backwards/forwards on the wear pads.

FIGS. 14 to 20 show the sequential sectors of rotation of the cams 17, 18, 19, 20 together with the associated movements of the knot anvil 28, the blade tool 27, the staple anvil 29, and the support tool 30. These movements of the knot anvil 28, the blade tool 27, the staple anvil 29, and the support tool 30 form a knot around a line-wire-stay-wire intersection. The staple cam 17 and support cam 18 rotate in a counter-clockwise direction and the knot cam 21 and blade cam 20 rotate in a clockwise direction. The following description refers to sectors. The sectors occur in the order described below, but the sectors are not necessarily the same or similar lengths.

Figure 14:
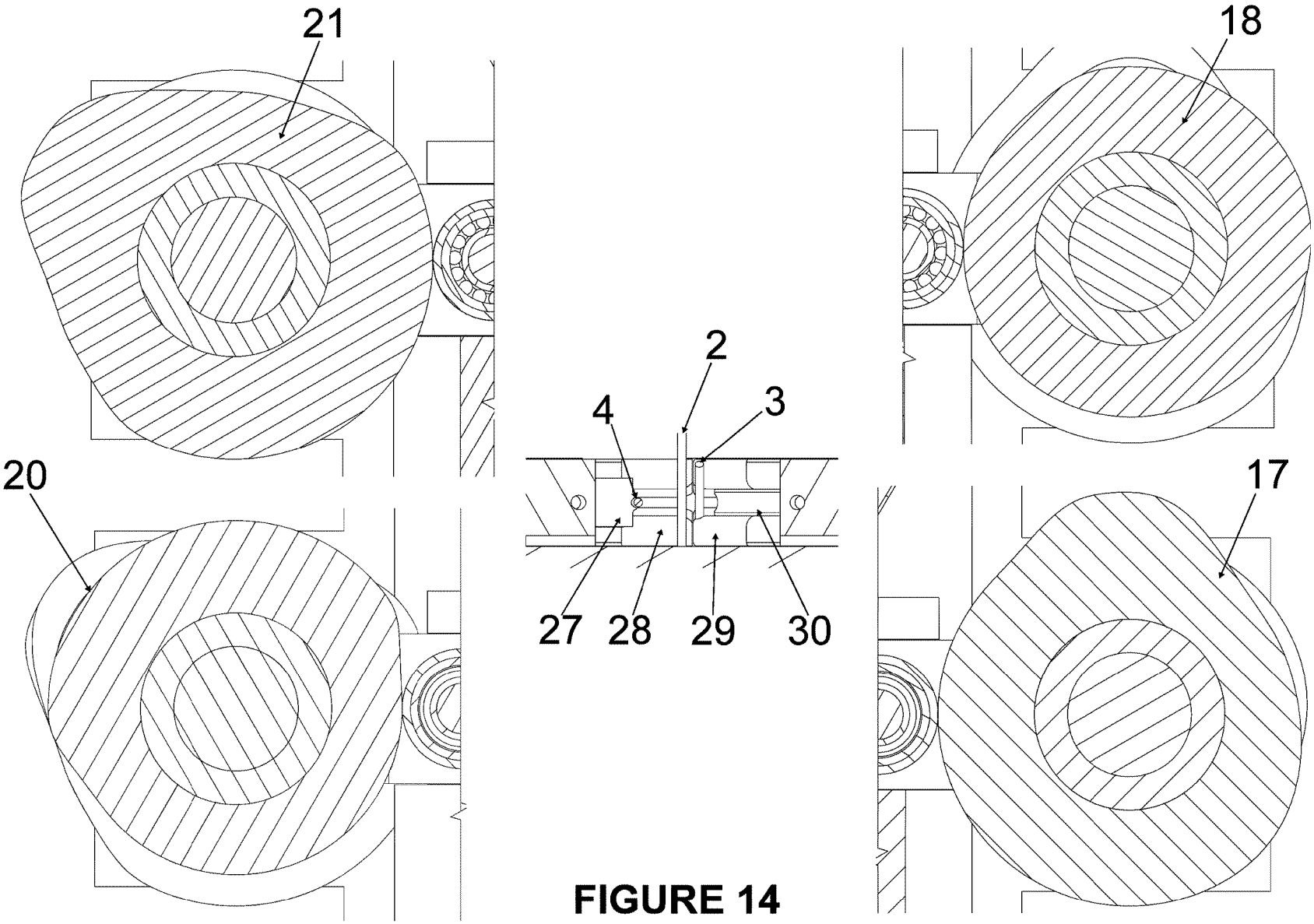
FIGS. 14 to 20 show the sequential sectors of rotation of the cams together with the associated movements of the knot anvil, the blade tool, the staple anvil, and the support tool.

With reference to FIG. 14, in an initial step of the method, the intersection is formed between a line-wire 2 and a stay-wire 4, which cross transversely. The line-wire is drawn through the knotting box 6. The stay-wire 4 is fed through the stay-wire guides and is supported in a notch 33 of the knot anvil 28. The stay-wire is fed into the knot box while the crimp drum 13 pulls the previous knot from the knot box. A knot-wire 3 is feed through the staple anvil 29.

Figure 15:
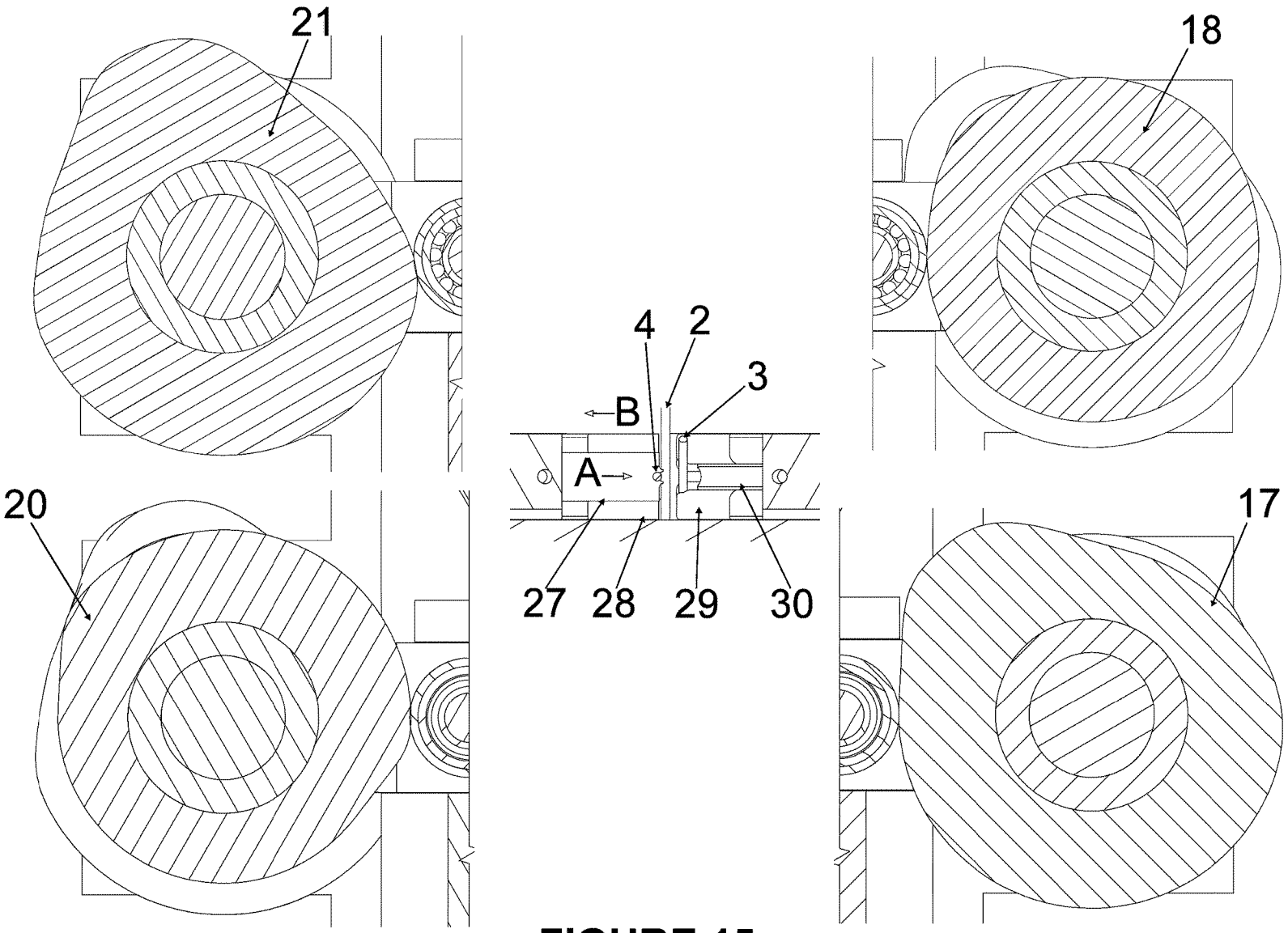
Figure 16:
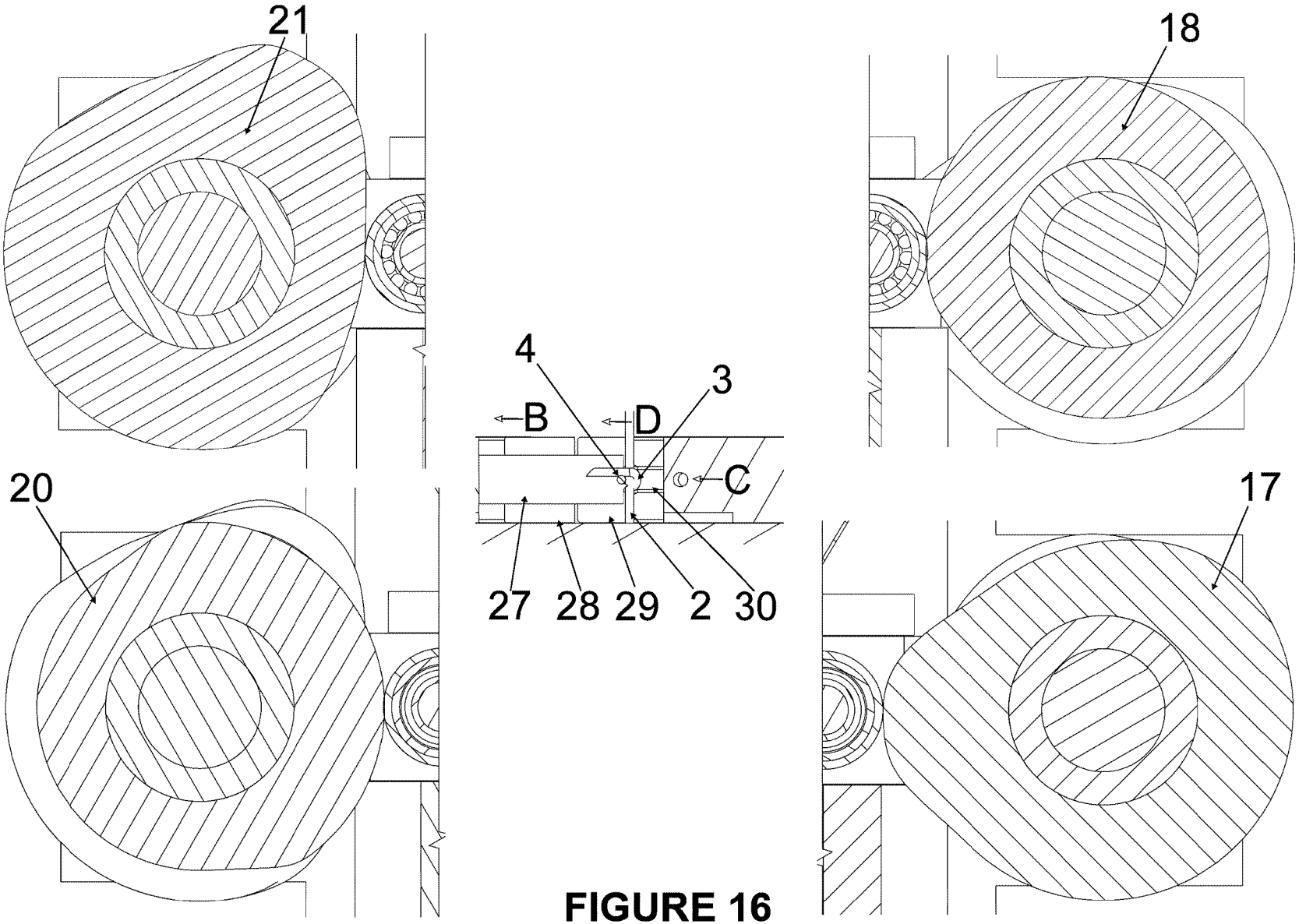

During a first sector, the blade tool 27 and blade drive bar 23 move rearwardly towards the intersection and accelerate in the direction of arrow A of FIG. 15. The blade tool 27 tool includes a notch 51 having concave curved surface configured to support the stay-wire 4. The notch 51 is defined by a pair of prongs 53. The stay-wire 4 is moved rearwardly and held against the line-wire 2. The other formers and drive bars are stationary during this sector. During the first sector, the stay-wire 4 is moved rearwardly, cut, and held against the line-wire 2. Subsequently, during a second sector, the blade tool 27 continues to move rearwardly towards the intersection, but decelerates, while the knot anvil 28 moves forwardly away from the intersection in the direction of arrow B and accelerates. This simultaneous deceleration of the blade tool 27 and blade drive bar 23, which is at the front and bottom of the knot box 6, and acceleration of the knot anvil 28 and knot drive bar 22, which is at the front and top of the knot box, results in the kinetic energy shifting from the bottom front moving bar 23 to the top front moving bar 22. In addition to having a simultaneous deceleration and acceleration, the movement of the bars 22, 23 is in opposite directions. That is the blade tool drive bar 27 moves towards the intersection while the knot anvil drive bar 28 moves away from the intersection.

Figure 21:
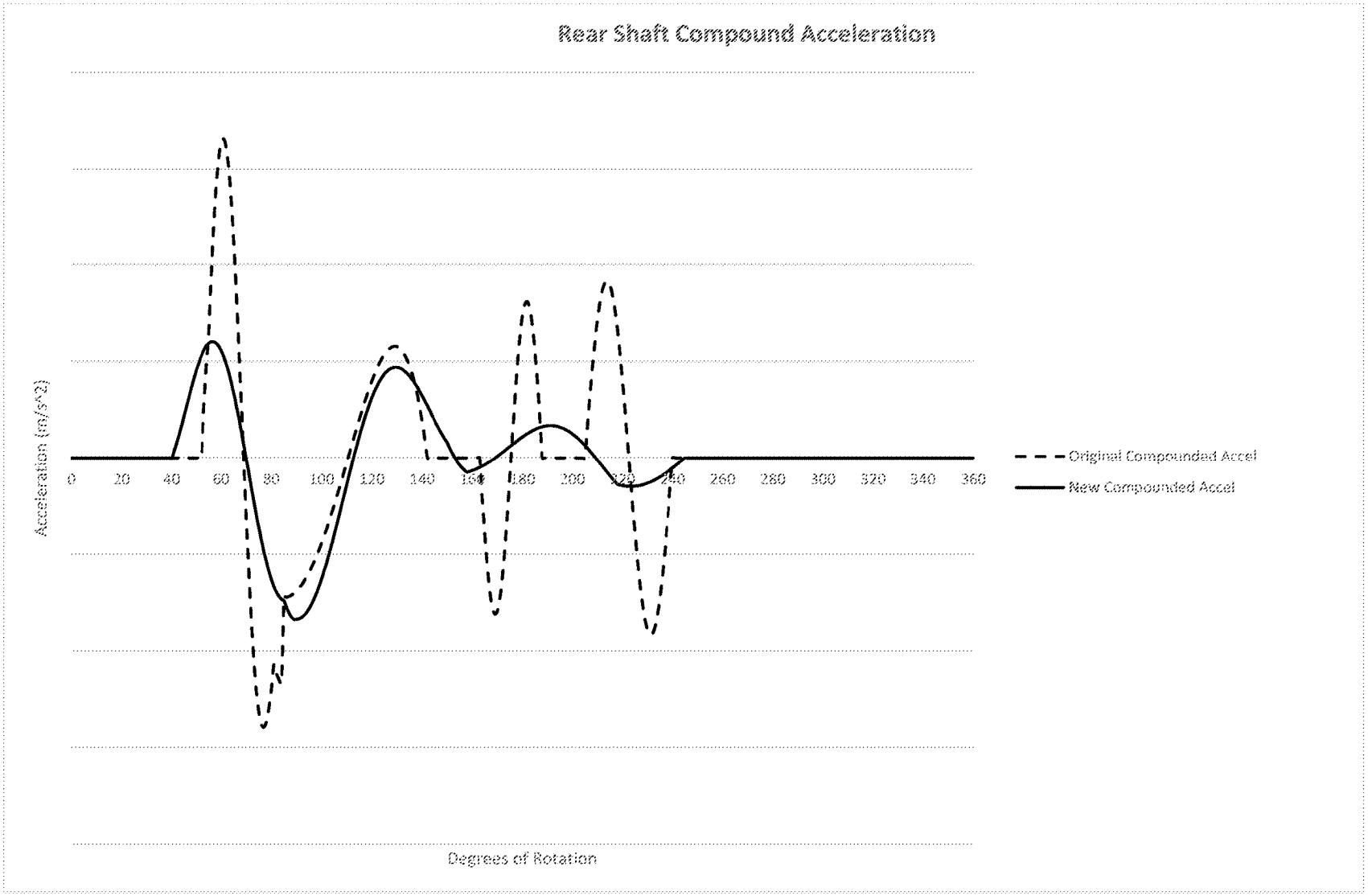
FIG. 21 is a graph showing the acceleration on the rear shaft of a conventional cam-driven knotted fence mesh forming machines compared to the acceleration on the rear shaft of the machine of FIG. 1 occurring over one shaft revolution (0-360 degrees).

Without the simultaneous deceleration/acceleration, energy would transferred back into the driving motor's windings or lost as frictional heating. By balancing this energy shift, both the forging and the crimping load when producing fence mesh can be reduced. An example of this is shown in FIG. 21, which is a graph demonstrating the acceleration on the rear shaft before and after cam load balance optimisation occurring over one shaft revolution (0-360 degrees). That figure shows the difference between the original cam moves (in dotted lines) and the new machine cam move (in solid lines) with reduced peaks and a smoother load motion.

During a third sector, the knot anvil 28, the staple anvil 29, and the support tool 30 move forwardly and accelerate in the direction indicated by Arrows B, C and D. This movement cuts the knot-wire and forms it into a staple, shown in FIG. 16. In particular, the staple anvil 29 moves in the direction indicated by Arrow C towards the line-wire-stay-wire intersection from the side opposite the blade tool notch 51, shears a length of the knot-wire 3, and bends the cut length of knot-wire 3 around the line-wire-stay-wire intersection to form a staple around the intersection. The staple anvil 29 includes a cutting edge 40 to shear the knot-wire 3. The staple anvil 29 also has a generally U-shaped forming surface 35 to bend the cut length of knot-wire 3 into a staple around the line-wire-stay-wire intersection. The support tool 30 has a bowl-shaped section 37 with a shallow concave curved surface 39. Movement of the line-wire-stay-wire intersection away from the knot-wire 3 during staple forming is prevented by the blade tool notch 51.

During a fourth sector, the knot anvil 28 continues to move forwardly away from the intersection but now decelerates while the staple anvil 29 and the support tool 30 moves forwardly towards the intersection and continue to accelerate. During a fifth sector, the staple anvil 29 and the support tool 30 move forwardly towards the intersection and decelerate. The simultaneous movement of the staple anvil 29 and the support tool 30 in the direction indicated by Arrow C support the bow of the bent knot-wire 3 within the shallow concave curved surface 39 in the support tool 30. The shallow concave curved surface 39 forms and supports the bow of the bent knot-wire 3. The line-wire-stay-wire intersection is at this time still supported by the blade tool notch 51.

Figure 17:
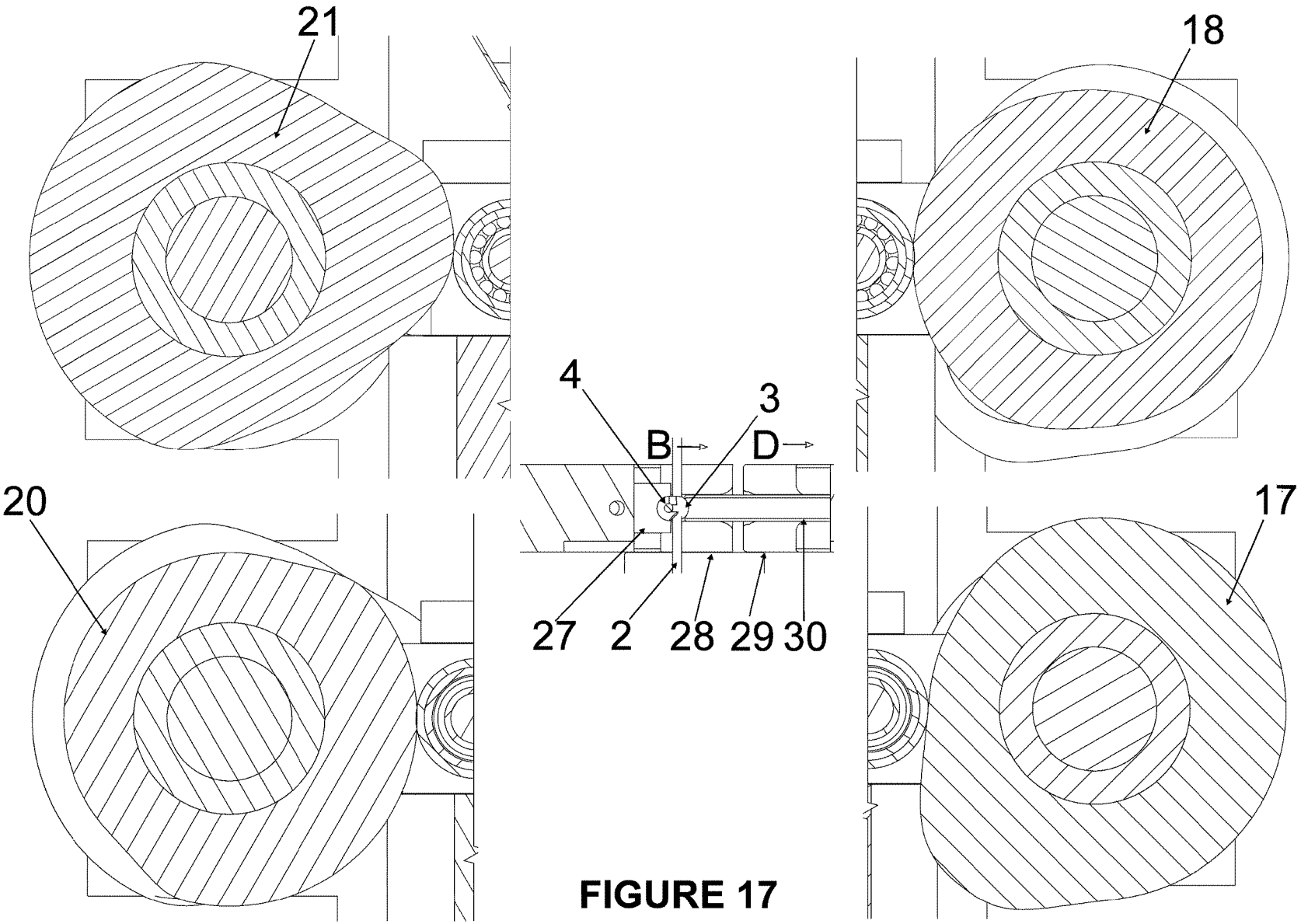
Figure 18:
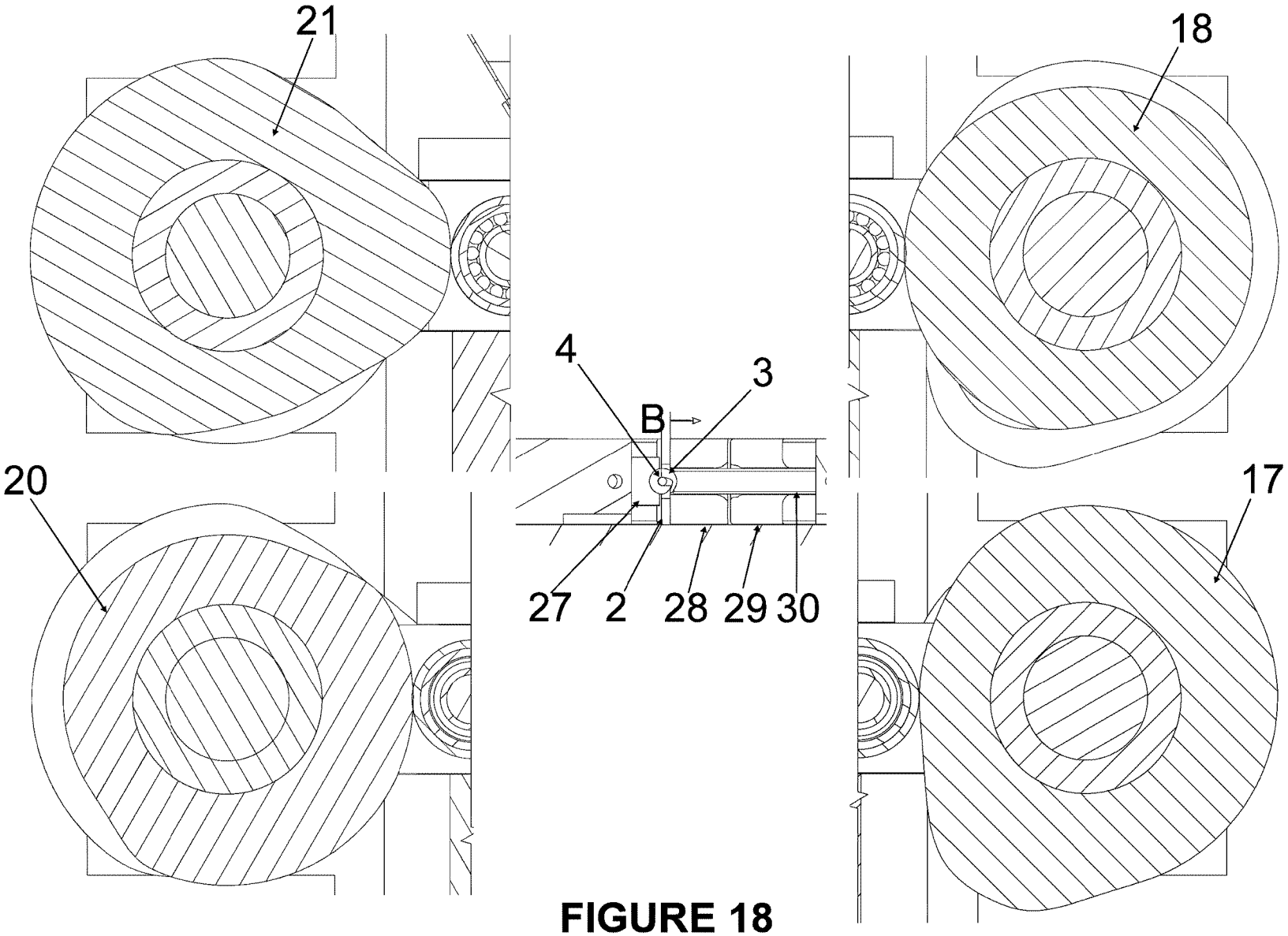

During a sixth sector, the knot anvil 28 and the staple anvil 29 move rearwardly and accelerate in the direction indicated by Arrows B and D of FIG. 17. The staple anvil 29 moves away from the intersection and the knot anvil 28 moves with the staple anvil 29 past the intersection in the direction indicated by Arrow B to the position shown in FIG. 18. FIG. 17 shows the formation of the knot form, FIG. 18 shows the final "crush" of the knot. The movement of the knot anvil 28 and the staple anvil 29 form the staple into a completed knot. During a seventh sector, the knot anvil 28 and the staple anvil 29 continue to move rearwardly but decelerate.

The knot anvil 28 also includes a generally U-shaped forming surface 33 which bends the ends of the cut length of knot-wire 3 and wraps these around the stay-wire 4. It will be appreciated that configuration of the forming surface 33 in the knot anvil 28 could be altered to wrap the legs of the staple around the line-wire 2 rather than the stay-wire 4, although this would require a more complex forming surface shape. Alternatively, the line-wire and the stay-wire could be swapped in the knot box for this purpose.

Figure 19:
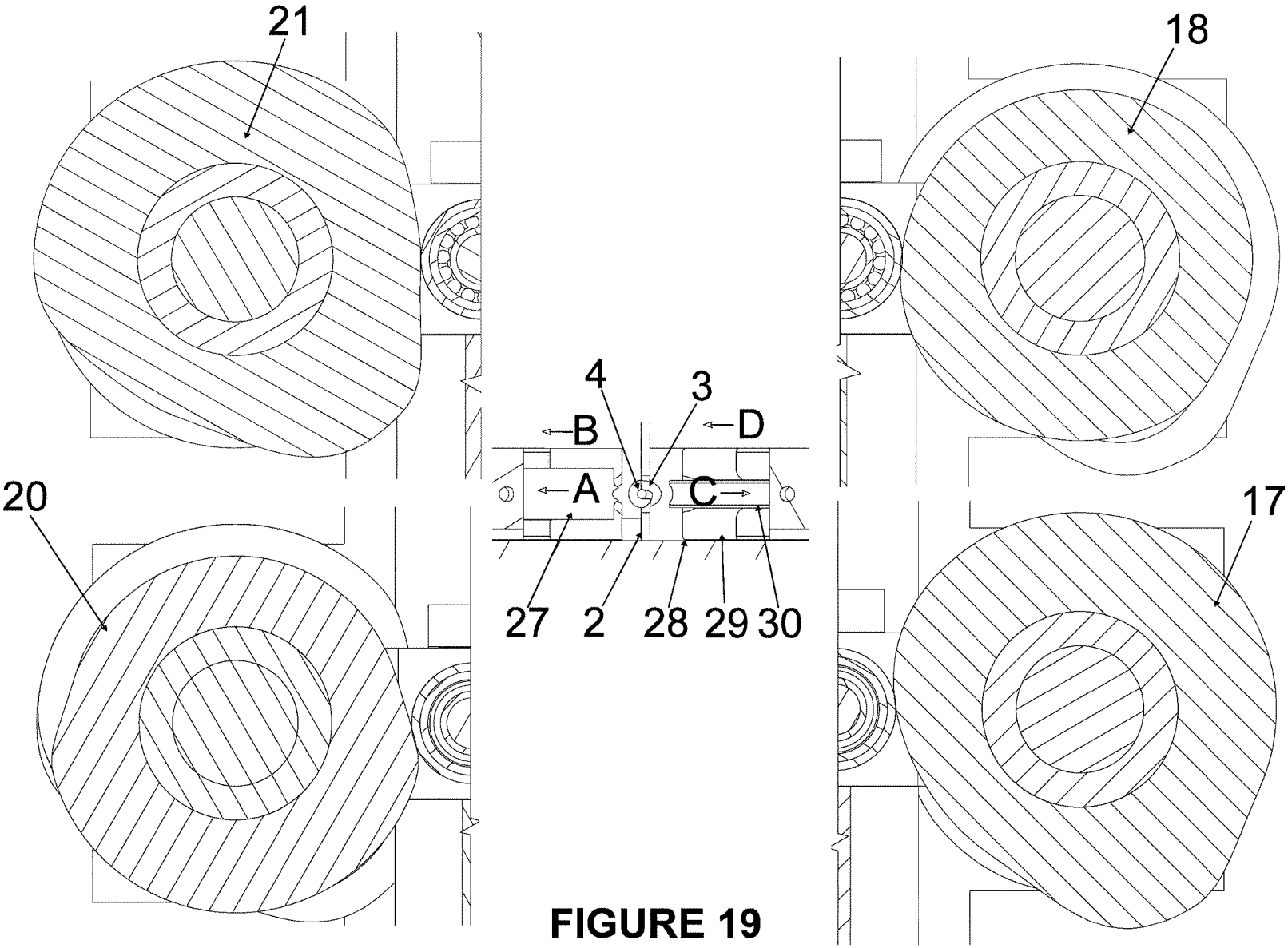

With reference to FIG. 19, during an eighth sector and ninth section, the knot anvil 28 moves forwardly from behind the intersection in the direction indicated by Arrow B, through the intersection and then away from the intersection and accelerates, leaving the blade tool 27 extended, which ejects the knot from the knot anvil 28. During the eighth sector, the staple anvil 29 moves forwardly towards the intersection in the direction indicated by Arrow D and accelerates, and the support tool 30 moves rearwardly away from the intersection in the direction indicated by Arrow C and accelerates. During the ninth sector, the knot anvil 28 continues to move forwardly away from the intersection and accelerate, the staple anvil 29 continues to move forwardly toward the intersection and accelerate, and the support tool 30 continues to move rearwardly away from the intersection and accelerate.

During a tenth sector and eleventh sector, the blade tool 27 moves away from the intersection ready for the mesh to be pulled upwardly away from the knot boxes 6. In particular, the knot anvil 28 moves forwardly away from the intersection and accelerates, the blade tool 27 moves forwardly away from the intersection and accelerates, the staple anvil 29 moves forwardly towards the intersection and accelerates, and the support tool 30 moves rearwardly away from the intersection and accelerates. During the eleventh sector, the knot anvil 28 continues to move forwardly away from the intersection and decelerates, the blade tool 27 moves, forwardly away from the intersection and accelerates, the staple anvil 29 moves forwardly towards the intersection and accelerates, and the support tool 30 moves rearwardly and decelerates. Similar to the simultaneous deceleration and acceleration described above in relation to the second sector, this simultaneous acceleration of the blade tool 27 and blade drive bar, which is at the front and bottom of the knot box, and deceleration of the knot anvil 28 and knot drive bar, which is at the front and top of the knot box, results in the kinetic energy shifting from the top front moving bar to the bottom front moving bar. In the eleventh sector, another simultaneous deceleration and acceleration of the rear bars is also occurring. That is, there is a simultaneous acceleration of the staple anvil 29 and staple drive bar, which is at the rear and bottom of the knot box, and deceleration of the support tool 30 and support drive bar, which is at the rear and top of the knot box. The simultaneous deceleration and acceleration results in the kinetic energy shifting from the top rear moving bar to the bottom rear moving bar. It is now possible for the mesh to be pulled away from the knot boxes, which occurs during the subsequent sector.

Figure 20:
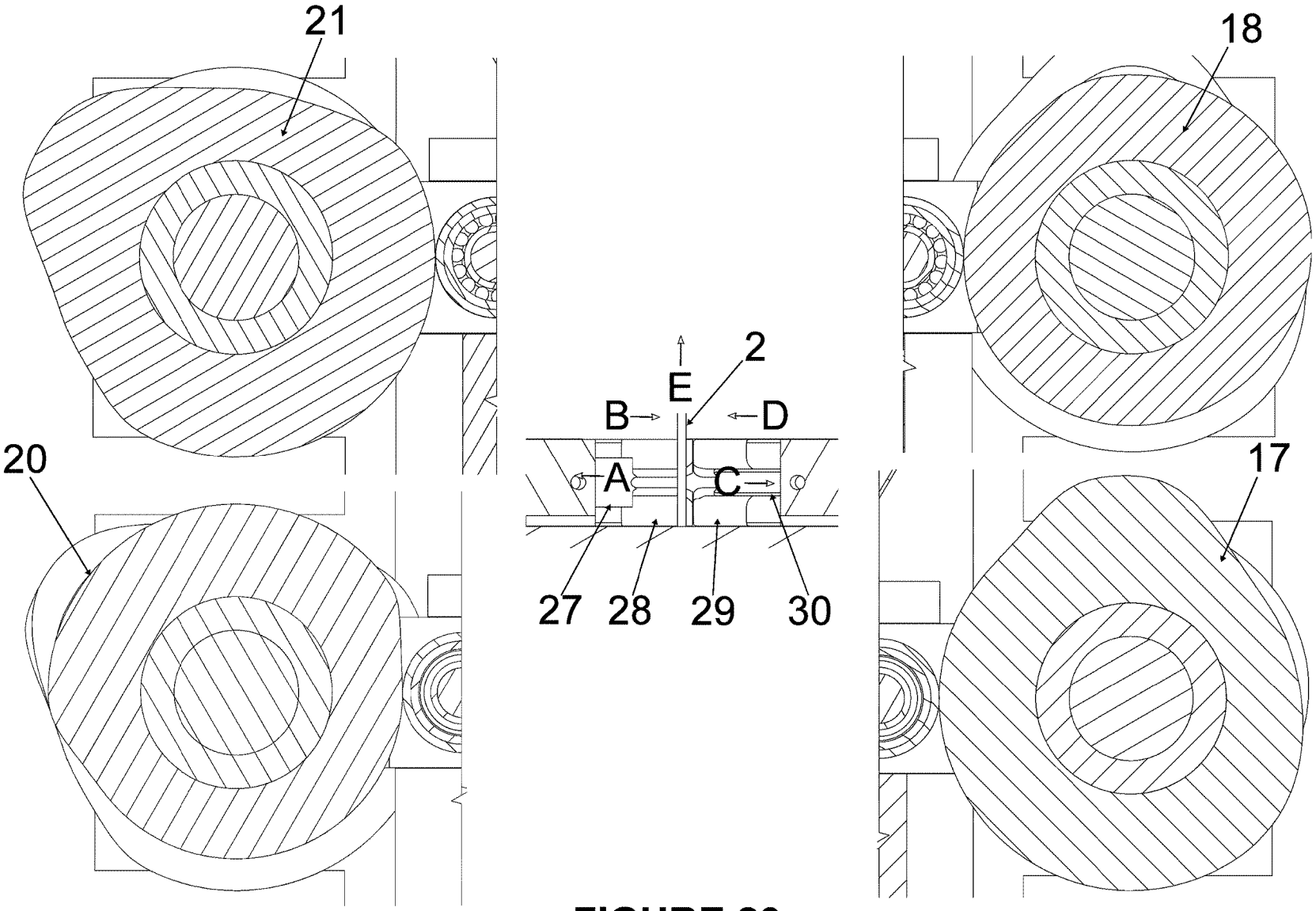

During a twelfth sector, the mesh is pulled upwardly away from the knot boxes 6 in the direction indicated by Arrow E of FIG. 20. The blade tool 27 moves forwardly away from the intersection in the direction indicated by Arrow A and decelerates, the staple anvil 29 is moves forwardly towards the intersection in the direction indicated by Arrow D and decelerates, and the support tool 30 move rearwardly away from the intersection in the direction indicated by Arrow C and decelerates. During this sector, the crimp drum rotates one step drawing the line-wires through the knotting boxes. The step of rotation draws the lines wires by a distance that is the desired pitch between the stay-wires.

During a thirteenth sector, the knot anvil 28 moves rearwardly towards the intersection and accelerates and the staple anvil 29 moves forwardly towards the intersection and decelerates. During a fourteenth sector, the knot anvil 28 continues to move rearwardly towards the intersection but decelerates, and the staple anvil 29 moves forwardly towards the intersection and decelerates. The knot anvil 28, blade tool 27, staple anvil 29, and support tool 30 are now back at the starting position. The stay-wire and knot-wire are fired into position and the cycle starts again.

In addition to the features and functions described above, each cam 17, 18, 19, 20 is also associated with a return cam follower. One example of a return cam follower 59 is shown in FIG. 6. The return cam follower 59 engages the inner profile of each cam. It will be understood that while the cams drive the bars and associated formers in one direction towards the line-wire-stay-wire intersection, the return cam followers 59 drive the bars and associated formers in the opposite direction away from the line-wire-stay-wire intersection.

Figure 25:
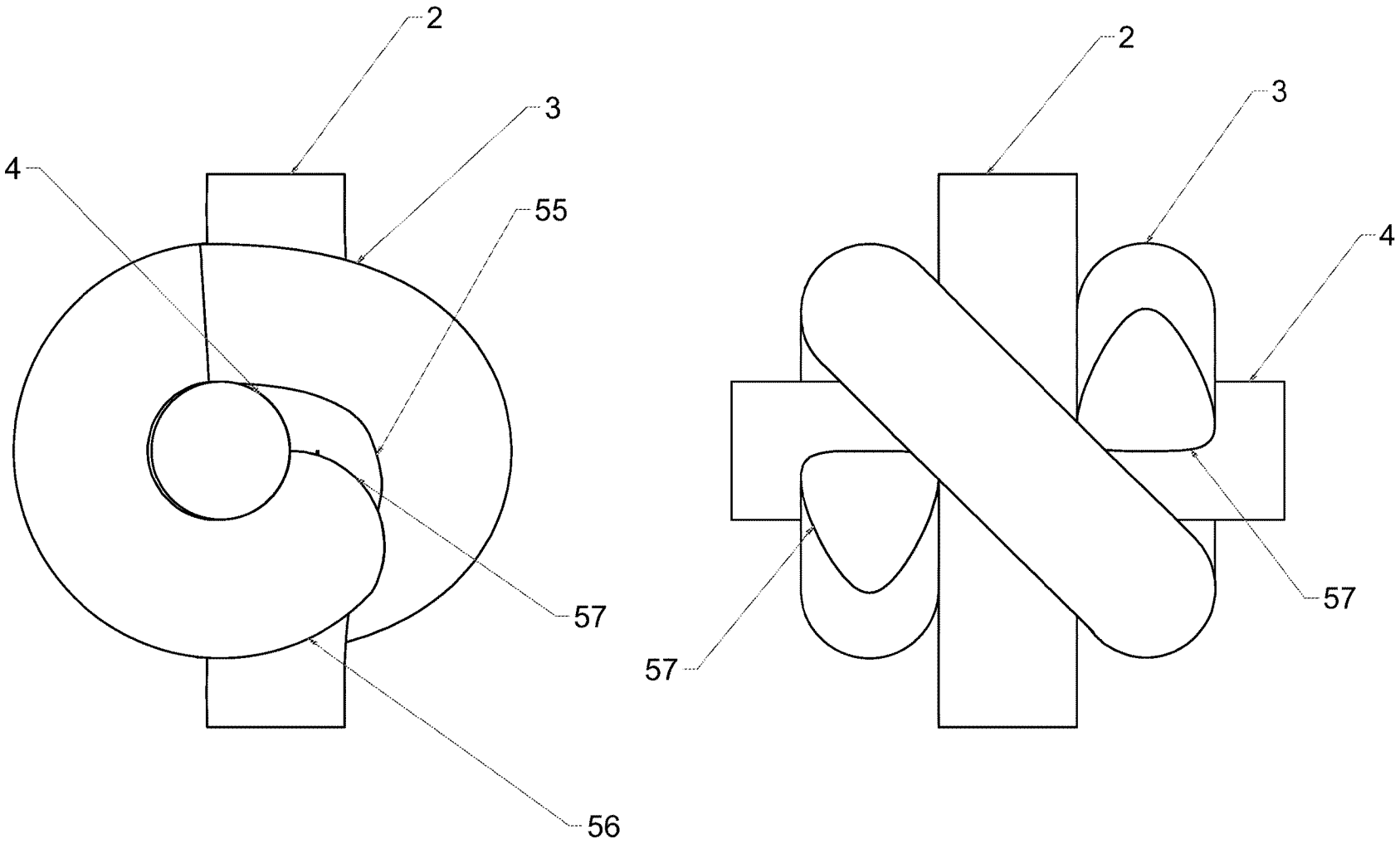
FIG. 25 shows the complete stiff stay knot resulting product.

As shown in FIG. 25, the final knot has a bow portion 55 which is seated against the line-wire 2 and extends diagonally around the line-wire-stay-wire intersection. The legs 56 of the final knot extend back around the stay-wire 4 in opposite directions substantially parallel to each other, toward the bow portion 55. The ends 57 of the legs 56 are flat and substantially flush with the line-wire 2, and have no protruding sharp edges. Therefore, the knot will not snag or cut the fur or flesh of an animal if it comes into contact with the ends 57 of the legs 56. The knotted wire mesh is also safer for handling during installation than conventional knotted wire mesh, due to a lack of sharp edges.

The tables below represent the movement of each anvil and tool during each sector. A represents acceleration, D represents deceleration. > represent movement towards the rear of the machine and < represents movement towards the front of the machine. - represents no movement of that anvil or tool.

Conventional machine for forming knotted fence mesh.

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| knot anvil | — | — | A< | D< | — | — | A> | D> | A< | D< | — | — | A> | D> |
| blade tool | A> | D> | — | — | — | — | — | — | — | — | A< | D< | — | — |
| staple anvil | — | — | — | — | A< | D< | A> | D> | — | — | — | — | A< | D< |
| support tool | — | — | — | — | A< | D< | — | — | A> | D> | — | — | — | — |

Machine for forming knotted fence mesh according to the embodiment described and shown in relation to FIGS. 1 to 24.

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| knot anvil | — | A< | A< | D< | — | A> | D> | A< | A< | A< | D< | — | A> | D> |
| blade tool | A> | D> | — | — | — | — | — | — | — | A< | A< | D< | — | — |
| staple anvil | — | — | A< | A< | D< | A> | D> | A< | A< | A< | A< | D< | D< | D< |
| support tool | — | — | A< | A< | D< | — | — | A> | A> | A> | D> | D> | — | — |

FIG. 21 is a graph showing the acceleration on the rear shaft of a conventional cam-driven knotted fence mesh forming machines compared to the acceleration on the rear shaft of the machine of FIG. 1 occurring over one shaft revolution (0-360 degrees).

Figure 22:
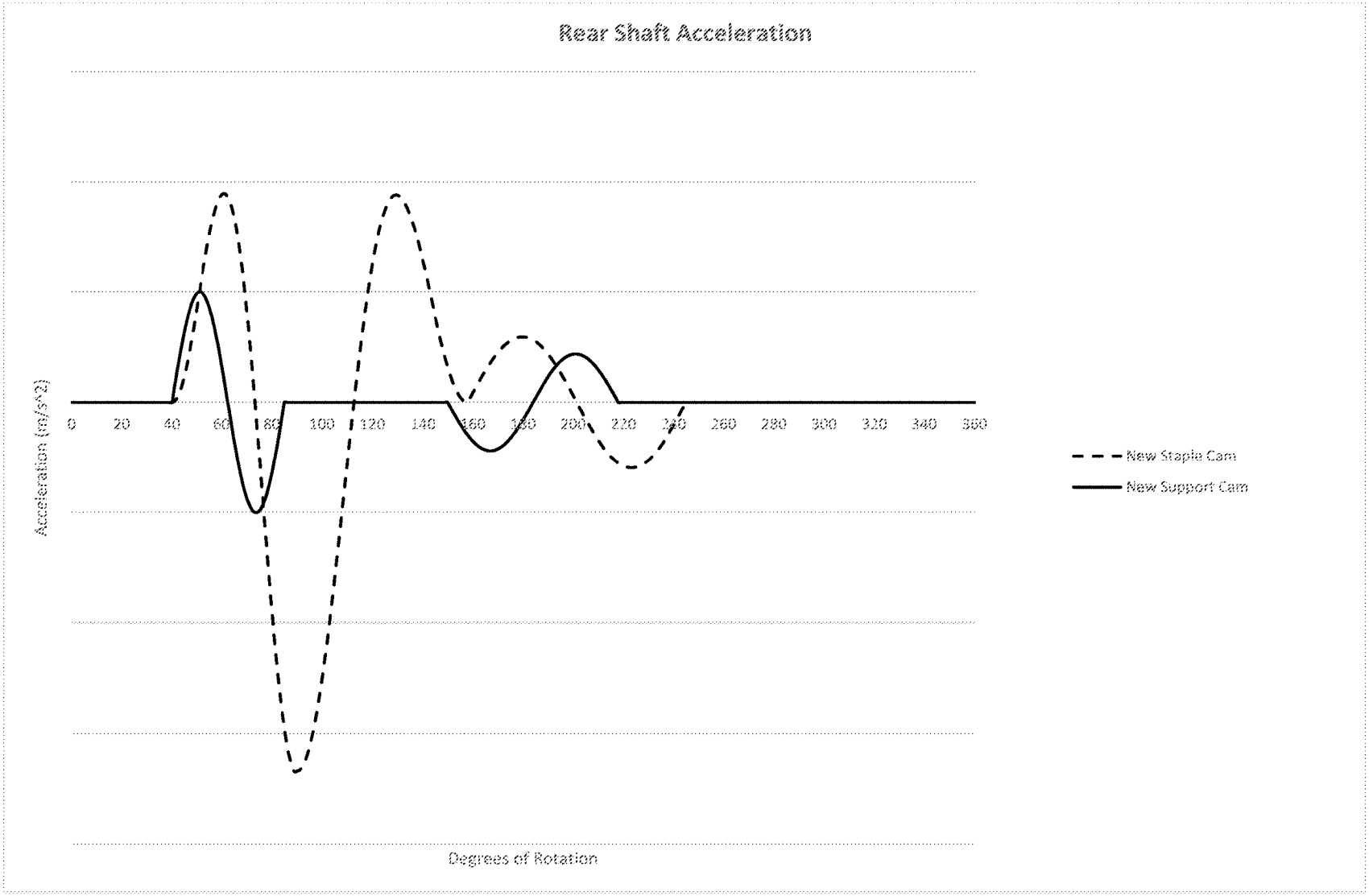
FIG. 22 is a graph showing the acceleration on the rear shaft of the machine of FIG. 1 occurring over one shaft revolution (0-360 degrees).

FIG. 22 is a graph showing the acceleration on the rear shaft of the machine of FIG. 1 occurring over one shaft revolution (0-360 degrees). As can be seen in FIG. 22, the support tool 27 decelerates while the staple anvil 28 accelerates during the second sector.

Figure 23:
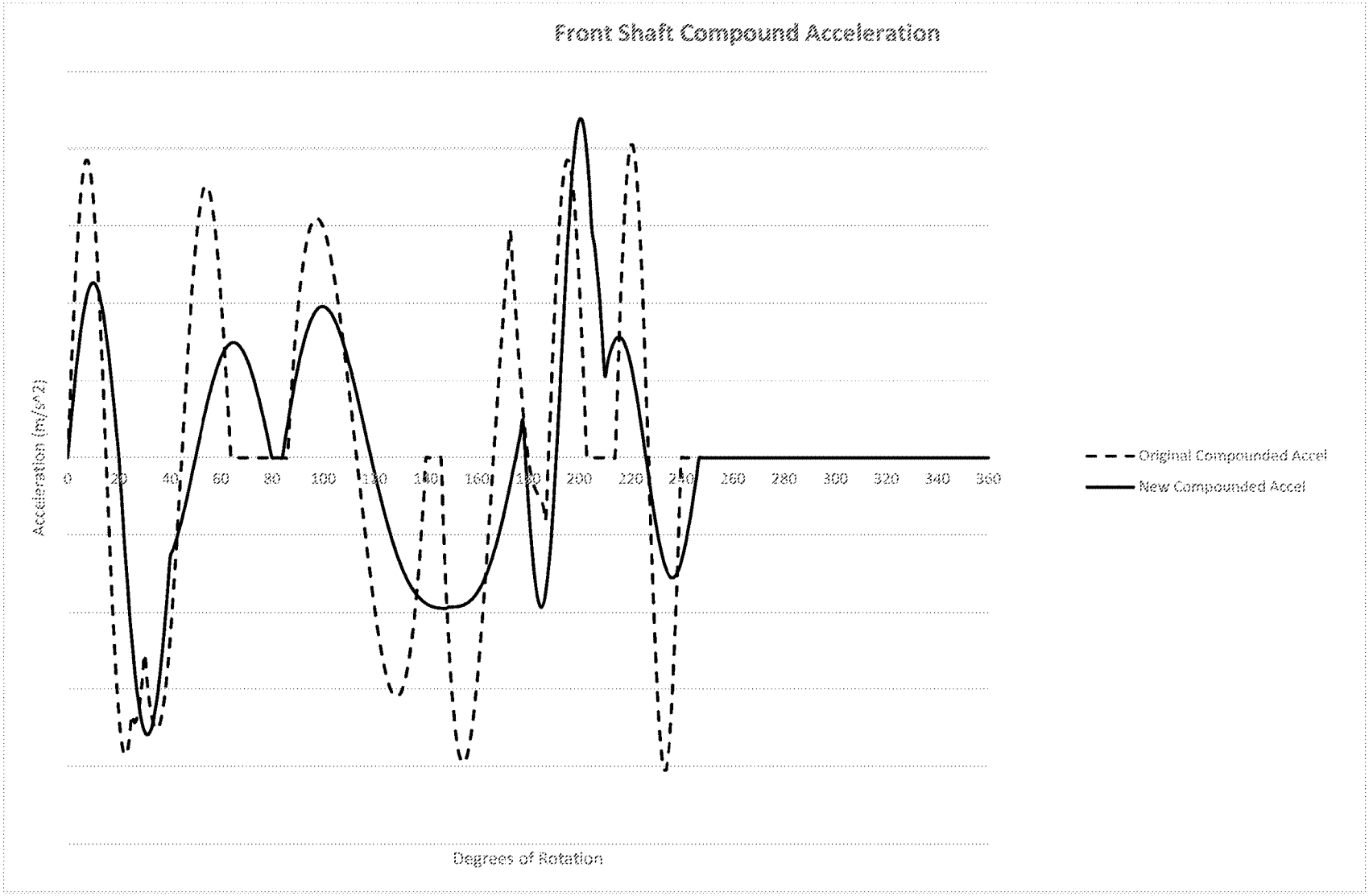
FIG. 23 is a graph showing the acceleration on the front shaft of a conventional cam-driven knotted fence mesh forming machines compared to the acceleration on the front shaft of the machine of FIG. 1 occurring over one shaft revolution (0-360 degrees).

FIG. 23 is a graph showing the acceleration on the front shaft of a conventional cam-driven knotted fence mesh forming machines compared to the acceleration on the front shaft of the machine of FIG. 1 occurring over one shaft revolution (0-360 degrees).

Figure 24:
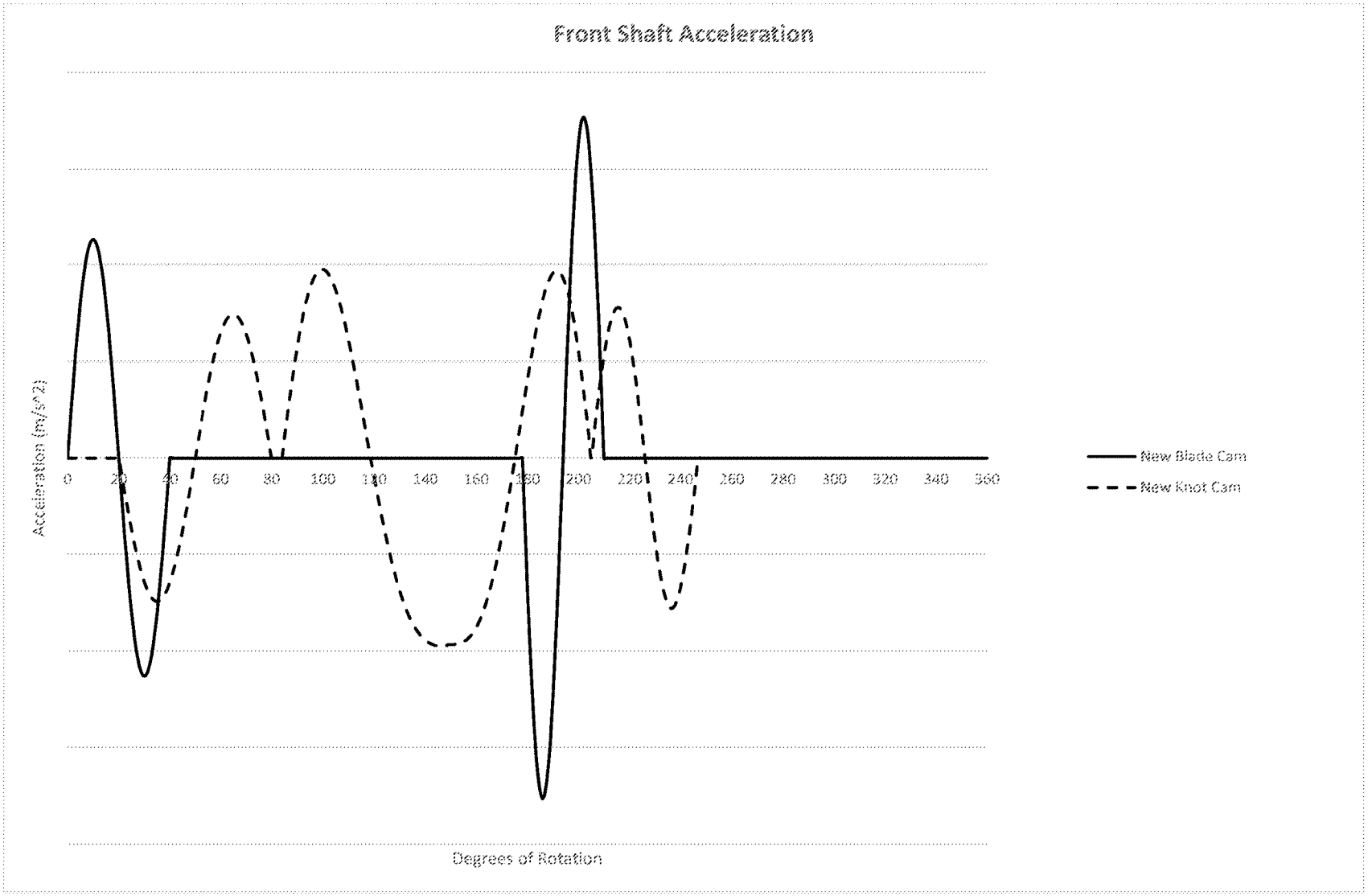
FIG. 24 is a graph showing the acceleration on the front shaft of the machine of FIG. 1 occurring over one shaft revolution (0-360 degrees).

FIG. 24 is a graph showing the acceleration on the front shaft of the machine of FIG. 1 occurring over one shaft revolution (0-360 degrees). As can be seen in FIG. 24, the knot anvil 29 accelerates while the blade tool 30 decelerates during the eleventh sector.

As mentioned above in relation to FIG. 1, the stay-wire 4 is propelled across the knot boxes using the Tri-drive. The stay-wire 4 is cut to the required length as it is placed in position, prior to the knots being formed.

It will be appreciated that the stay-wire 4 will be wrapped around the end line-wires 2 in the completed fence mesh. This is achieved through the use of twister units, which are common to fence machinery. The operation of such twister units will be understood by a person skilled in the art and will not be described further here.

The preferred knot box, machine and method described above have a number of advantages over those that are conventionally known.

A conventional knotted fence mesh forming machine has an operating rate of approximately 80 beats per minute. It has been found that by utilising simultaneous cam acceleration/deceleration, an operating rate of at least 100 beats per minute is attainable.

The machine has improved efficiency during the crimping and forging of the knot. By using the relatively large cams, as described above, the cams had greater inertia to store localised energy as well as reduced pressure angles. This results in lower torque required to produce a knot per cycle then a conventionally known machine producing an equivalent fence. Overall this means a machine having the features cams described herein requires less energy to produce the same fence, creating a more efficient machine.

The machine described herein will have lower vibrations as it operates due to both larger cams and simultaneous cam acceleration/decelerations, which dampen the effective vibrations produced as the machine operates. In addition, the larger cams allow the machine to have a lower average machine torque.

The machine described herein will have the ability to perform more 2" line-wire spacings not achievable on standard machines.

Preferred embodiments of the invention have been described by way of example only and modifications may be made thereto without departing from the scope of the invention.

For example, while the cam driven actuation of former and/or supports in knot boxes of a fence mesh forming machine is described above with reference to a particular embodiment knot box, it will be appreciated that it will have application with other types of knot boxes.

The invention claimed is:

1. A machine for forming knotted fence mesh in a step-wise operation, the machine comprising:

a plurality of side by side knot boxes each for forming a knot at an intersection between a line-wire and a stay-wire, each of the knot boxes comprising:

a first pair of formers configured to move towards the line-wire-stay-wire intersection from a front side forming a knot at the line-wire-stay-wire intersection at each operation of the knot box;

a second pair of formers configured to move towards the line-wire-stay-wire intersection from a rear side at said each operation of the knot box;

a cam drive system configured to move a plurality of the first pair of formers and the second pair of formers at each operation of the knot boxes, the cam drive system having:

a front cam assembly having a front pair of cams associated with the first pair of formers and a rear cam assembly having a rear pair of cams associated with the second pair of formers, wherein each of the cams has a respective profile, wherein the profiles of each of the front pair of cams are configured such that during a sector of a rotation of the front pair of cams, one former of the first pair of formers accelerates while the other former of the first pair of formers simultaneously decelerates.

2. The machine as claimed in claim 1, wherein the profile of each of the rear pair of cams is configured such that during a sector of a rotation of the rear pair of cams, one former of the second pair of formers accelerates while the other former of the second pair of formers simultaneously decelerates.

3. The machine as claimed in claim 1, wherein the cam drive system is configured to simultaneously move the first pair of formers of all of the knot boxes or the second pair of formers of all of the knot boxes at each operation of the knot boxes.

4. The machine as claimed in claim 1, wherein the cam drive system is configured to move the first pair of formers of all of the knot boxes simultaneously with one another and the second pair of formers of all of the knot boxes simultaneously with one another at each operation of the knot boxes.

5. The machine as claimed in claim 1, wherein the front cam assembly comprises a front cam shaft configured to rotate at a constant speed.

6. The machine as claimed in claim 1, wherein the rear cam assembly comprises a rear cam shaft configured to rotate at a constant speed.

7. The machine as claimed in claim 1, wherein the first pair of formers comprises a blade tool and the blade tool is associated with a blade cam of the front pair of cams.

8. The machine as claimed in claim 7, wherein the blade tool includes a notch having concave curved surface configured to support the stay-wire.

9. The machine as claimed in claim 7, wherein during a first sector of a rotation of the front pair of cams, the blade tool is configured to move rearwardly towards the intersection and accelerate.

10. The machine as claimed in claim 9, wherein the sector of rotation of the front pair of cams is a second sector of a rotation of the front pair of cams after the first sector, and the one former of the first pair of formers is the blade tool configured to move rearwardly towards the intersection and decelerate and the other former of the first pair of formers is a knot anvil configured to move forwardly away from the intersection and accelerate.

11. The machine as claimed in claim 10, wherein the second pair of formers comprises a staple anvil associated with a staple cam of the rear pair of cams, wherein the second pair of formers comprises a support tool associated with a support cam of the rear pair of cams, and wherein during a third sector after the second sector, the knot anvil is configured to move forwardly away from the intersection and accelerate and the staple anvil and the support tool are configured to move forwardly towards the intersection and accelerate.

12. The machine as claimed in claim 11, wherein during a fourth sector after the third sector, the knot anvil is configured to move forwardly away from the intersection and decelerate while the staple anvil and the support tool are configured to move forwardly towards the intersection and accelerate.

13. The machine as claimed in claim 12, wherein during a fifth sector after the fourth sector, the staple anvil and the support tool are configured to move forwardly towards the intersection and decelerate.

14. The machine as claimed in claim 13, wherein during a sixth sector after the fifth sector, the knot anvil and the staple anvil are configured to move rearwardly and accelerate, and the staple anvil is configured to move away from the intersection and the knot anvil is configured to move with the staple anvil past the intersection.

15. The machine as claimed in claim 14, wherein during a seventh sector after the sixth sector, the knot anvil and the staple anvil are configured to move rearwardly away from the intersection and decelerate.

16. The machine as claimed in claim 15, wherein during an eighth sector after the seventh sector, the knot anvil is configured to move forwardly from behind the intersection and accelerate, the staple anvil is configured to move forwardly towards the intersection and accelerate, and the support tool is configured to move rearwardly away from the intersection and accelerate.

17. The machine as claimed in claim 16, wherein during a ninth sector after the eighth sector, the knot anvil is configured to move forwardly away from the intersection and accelerate, the staple anvil is configured to move forwardly toward the intersection and accelerate, and the support tool is configured to move rearwardly away from the intersection and accelerate.

18. The machine as claimed in claim 17, wherein during a tenth sector after the ninth sector, the knot anvil is configured to move forwardly away from the intersection and accelerate, the blade tool is configured to move forwardly away from the intersection and accelerate, the staple anvil is configured to move forwardly toward the intersection and accelerate, and the support tool is configured to move rearwardly away from the intersection and accelerate.

19. The machine as claimed in claim 18, wherein the profile of each of the rear pair of cams is configured such that during a sector of a rotation of the rear pair of cams, one former of the second pair of formers accelerates while the other former of the second pair of formers simultaneously decelerates, wherein during an eleventh sector after the tenth sector, the eleventh sector being the sector of a rotation of the rear pair of cams, the knot anvil is configured to move forwardly away from the intersection and decelerate, the blade tool is configured to move forwardly away from the intersection and accelerate, the staple anvil is configured to move forwardly toward the intersection and accelerate, and the support tool is configured to move rearwardly away from the intersection and decelerate.

20. The machine as claimed in claim 19, wherein during a twelfth sector after the eleventh sector, the blade tool is configured to move forwardly away from the intersection and decelerate, the staple anvil is configured to move forwardly toward the intersection and decelerate, and the support tool is configured to move rearwardly away from the intersection and decelerate.

21. The machine as claimed in claim 20, wherein during a thirteenth sector after the twelfth sector, the knot anvil is configured to move rearwardly toward the intersection and accelerate and the staple anvil is configured to move forwardly toward the intersection and decelerate.

22. The machine as claimed in claim 21, wherein during a fourteenth sector after the thirteenth sector, the knot anvil is configured to move rearwardly toward the intersection and decelerate and the staple anvil is configured to move forwardly toward the intersection and decelerate.

23. The machine as claimed in claim 1, wherein the first pair of formers comprises a knot anvil and the knot anvil is associated with a knot cam of the front pair of cams.

24. The machine as claimed in claim 23, wherein the knot anvil includes a generally U-shaped forming surface.

25. The machine as claimed in claim 1, wherein the second pair of formers comprises a staple anvil and the staple anvil is associated with a staple cam of the rear pair of cams.

26. The machine as claimed in claim 25, wherein the staple anvil includes a cutting edge configured to shear the knot-wire.

27. The machine as claimed in claim 25, wherein the staple anvil includes a generally U-shaped forming surface.

28. The machine as claimed in claim 1, wherein the second pair of formers comprises a support tool and the support tool is associated with a support cam of the rear pair of cams.

29. The machine as claimed in claim 28, wherein the support tool includes a shallow concave curved surface configured to form and support a bow of the bent knot-wire.

30. The machine as claimed in claim 1, further comprising a drive bar associated with each cam.

31. The machine as claimed in claim 30, further comprising a cam follower between each cam and the associated drive bar.

32. The machine as claimed in claim 1, further comprising a return cam follower associated with each cam.

* * * * *